US009349361B2

(12) United States Patent
Radmacher et al.

(10) Patent No.: US 9,349,361 B2
(45) Date of Patent: May 24, 2016

(54) MOVABLE SENSING DEVICE FOR STRINGED MUSICAL INSTRUMENTS

(71) Applicant: RODMACHER ENGINEERING, LLC, Fresno, CA (US)

(72) Inventors: Richard Radmacher, Visalia, CA (US); Eric Ramos, Visalia, CA (US); Alan Robertson, Fresno, CA (US)

(73) Assignee: RODMACHER ENGINEERING, LLC, Fresno, CA (US)

( * ) Notice: Subject to any disclaimer, the term of this patent is extended or adjusted under 35 U.S.C. 154(b) by 0 days.

(21) Appl. No.: 14/829,420

(22) Filed: Aug. 18, 2015

(65) Prior Publication Data

US 2016/0049142 A1 Feb. 18, 2016

Related U.S. Application Data

(60) Provisional application No. 62/038,553, filed on Aug. 18, 2014.

(51) Int. Cl.
*G10H 3/18* (2006.01)

(52) U.S. Cl.
CPC ..... *G10H 3/181* (2013.01)

(58) Field of Classification Search
CPC ..... G10H 3/18; G10H 3/181; G10D 3/00
USPC ..... 84/726
See application file for complete search history.

(56) References Cited

U.S. PATENT DOCUMENTS

| | | | | | |
|---|---|---|---|---|---|
| 2,500,172 | A * | 3/1950 | Gillenwater | 84/723 |
| 4,171,659 | A * | 10/1979 | Tumminaro | 84/723 |
| 4,281,573 | A * | 8/1981 | Yarema | 84/741 |
| 4,282,789 | A * | 8/1981 | Lamborn | 84/727 |
| 4,387,621 | A * | 6/1983 | Franzmann | 84/735 |
| 4,428,273 | A * | 1/1984 | Favron | 84/317 |
| 4,516,462 | A * | 5/1985 | Schulze | 84/739 |
| 4,526,082 | A * | 7/1985 | Ables | 84/325 |
| 5,449,858 | A * | 9/1995 | Menning et al. | 84/727 |
| 5,693,904 | A * | 12/1997 | Kihneman et al. | 84/725 |
| 5,864,083 | A * | 1/1999 | Caren | 84/737 |
| 6,288,320 | B1 * | 9/2001 | Murakami et al. | 84/622 |
| 7,227,068 | B1 * | 6/2007 | Van Doren | 84/297 R |
| 7,667,129 | B2 * | 2/2010 | Chidlaw et al. | 84/723 |

FOREIGN PATENT DOCUMENTS

WO 9011592 A1 10/1990

* cited by examiner

*Primary Examiner* — Jeffrey Donels
(74) *Attorney, Agent, or Firm* — Kunzler Law Group

(57) ABSTRACT

Apparatuses and systems are disclosed for movable sensing for stringed instruments. A string selector module selects one or more strings of a stringed instrument in response to a user of the stringed instrument positioning at least a portion of the string selector module over the one or more selected strings. The stringed instrument includes a plurality of strings, and the plurality of strings includes the one or more selected strings and one or more unselected strings. A sensor module produces an electrical signal in response to vibration of the one or more selected strings.

26 Claims, 19 Drawing Sheets

MOVABLE SENSING DEVICE FOR STRINGED MUSICAL INSTRUMENTS

CROSS-REFERENCES TO RELATED APPLICATIONS

This application claims the benefit of U.S. Provisional Patent Application No. 62/038,553 entitled "MOVABLE SENSING DEVICE FOR STRINGED MUSICAL INSTRUMENTS" and filed on Aug. 18, 2014 for Richard Radmacher et al., which is incorporated herein by reference.

FIELD

This invention relates to stringed instruments and more particularly relates to sensing devices for stringed instruments.

BACKGROUND

Various types of sensing devices are used to produce an electric signal that can be recorded or amplified for stringed instruments. For example, vibrating guitar strings may be sensed for amplification or recording by using an electromagnetic pickup or pickups that are integrated with the guitar. Integrating a sensing device or devices with a guitar can provide consistent sound quality. However, typical electrically amplified guitars are limited to fixed sensing devices positioned under the guitar strings and fastened to the body of the guitar or a microphone or microphones in fixed positions attached to or positioned near the guitar.

SUMMARY

An apparatus is disclosed for movable sensing for stringed instruments. In one embodiment, an apparatus includes a string selector module that selects one or more strings of a stringed instrument in response to a user of the stringed instrument positioning at least a portion of the string selector module over the one or more selected strings. In a certain embodiment, the stringed instrument includes a plurality of strings, and the plurality of strings includes the one or more selected strings and one or more unselected strings. In a further embodiment, a sensor module produces an electrical signal in response to vibration of the one or more selected strings.

In one embodiment, the electrical signal produced by the sensor module is a first electrical signal and the stringed instrument also includes one or more main sensors that generate a second electrical signal in response to vibration of the plurality of strings for the stringed instrument. The first electrical signal differs from the second electrical signal. In another embodiment, the sensor module is coupled to the string selector module. In a certain embodiment, the sensor module moves with the string selector module when the user positions the string selector module to select the one or more selected strings.

In one embodiment, the sensor module includes a pickup and the string selector module includes a mechanical device. In a certain embodiment, a portion of the mechanical device passes over the strings of the stringed instrument. In a further embodiment, the pickup is positioned on the mechanical device to pass over the strings of the stringed instrument as the portion of the mechanical device passes over the strings.

In one embodiment, the mechanical device includes a mechanical arm that pivots about a pivot point. In a certain embodiment, a portion of the mechanical arm passes over the strings of the stringed instrument. In a further embodiment, the pickup is positioned on the mechanical arm to pass over the strings of the stringed instrument as the portion of the mechanical arm passes over the strings.

In one embodiment, a friction control device that adjusts an amount of friction between the mechanical arm and the pivot point. In some embodiments, a stop coupled to the stringed instrument limits travel of the mechanical arm. In a certain embodiment, a flexible stop point coupled to the stringed instrument that limits travel of the mechanical arm. In a further embodiment, the mechanical arm moves past the flexible stop point in response to an action of the user. In one embodiment, the pickup is positioned with respect to the mechanical arm such that, when the pickup is positioned over treble strings of the stringed instrument, a width of a pickup range across the strings is greater than when the pickup is positioned over bass strings of the stringed instrument.

In one embodiment the mechanical device includes a slider in a channel positioned over the strings of the stringed instrument. In a certain embodiment, the slider passes over the strings of the stringed instrument. In a further embodiment, the pickup is positioned on the slider such that the pickup passes over the strings of the stringed instrument as the slider passes over the strings.

In a certain embodiment, a height adjustment device adjusts a distance between the sensor module and the plurality of strings. In one embodiment, the sensor module includes a magnetic pickup and an electrically grounded wire coil wrapped around the magnetic pickup.

In one embodiment, the string selector module is positioned external to the stringed instrument and is configured to pass over the strings of the stringed instrument. In a certain embodiment, the sensor module includes a pickup for each string, and the string selector module includes a position for each string of the stringed instrument. In a further embodiment, the sensor module activates a pickup to detect sound for a string in response to the string selector module being positioned to correspond to the string.

In one embodiment, the string selector module includes a mechanical device and a position sensor. In a certain embodiment, the position sensor determines a position of the mechanical device with respect to the one or more strings. In a further embodiment, the string selector module selects the string corresponding to the position of the mechanical device as determined by the position sensor, and activates the pickup corresponding to the selected string.

In one embodiment, the position sensor determines a position of the mechanical device relative to the plurality of strings. In a further embodiment, the string selector module activates the pickups corresponding to the selected strings.

In one embodiment, the string selector module is positioned external to the stringed instrument and is configured to pass over the strings of the stringed instrument. In a certain embodiment, the sensor module is positioned within the stringed instrument at a location between the strings of the stringed instrument and a center of the stringed instrument. In a further embodiment, movement of the string selector module to pass over the strings causes movement of the sensor module under the strings, and a position of the string selector module relative to the one or more strings positions the sensor module under the one or more strings.

In one embodiment, the sensor module is positioned in a slot in a face of the stringed instrument such that the sensor module is exposed to the strings of the stringed instrument. In a further embodiment, movement of the selector module causes movement of the sensor module by a coupling mechanism. In a certain embodiment, the coupling mechanism includes a direct coupling mechanism that directly connects the string selector module to the sensor module, and/or an indirect coupling mechanism indirectly connects the string selector module to the sensor module. In a further embodiment, the indirect coupling mechanism moves the sensor module in response to detecting movement of the string selector module.

In a certain embodiment, the sensor module moves over the strings of the stringed instrument at a fixed distance from the strings. In one embodiment, the stringed instrument is manufactured with the selector module and/or the sensor module. In another embodiment, the selector module and the sensor module are provided separately from the stringed instrument.

In one embodiment, an isolation transformer module isolates an electrical ground for a first amplification module, that amplifies the electrical signal from the sensor module, from an electrical ground for a second amplification module that amplifies a second electrical signal from one or more main sensors that produce the second electrical signal in response to vibration of the plurality of strings for the stringed instrument.

A system is disclosed for movable sensing for stringed instruments. In one embodiment, a stringed instrument includes a plurality of strings and one or more main sensors that produce a first electrical signal in response to vibration of the plurality of strings. In a certain embodiment, a string selector module selects one or more strings of the stringed instrument in response to a user of the stringed instrument positioning at least a portion of the string selector module over the one or more selected strings. In a further embodiment, the plurality of strings includes the one or more selected strings and one or more unselected strings. In certain embodiments, a sensor module produces a second electrical signal in response to vibration of the one or more selected strings.

In one embodiment, the stringed instrument includes a stereo output jack. In a certain embodiment, the first electrical signal is coupled to a first stereo output channel for the stereo output jack and the second electrical signal is coupled to a second stereo output channel for the stereo output jack.

In one embodiment, a first amplification module amplifies the first electrical signal, and a second amplification module amplifies the second electrical signal. In a further embodiment, a splitter module connects the first electrical signal from the stereo output jack to the first amplification module and connects the second electrical signal from the stereo output jack to the second amplification module.

Another apparatus is disclosed for movable sensing for stringed instruments. In one embodiment, a string selector module selects one or more strings of a stringed instrument in response to a user of the stringed instrument positioning at least a portion of the string selector module over the one or more selected strings. In a certain embodiment, the stringed instrument includes a plurality of strings. In a further embodiment, the plurality of strings includes the one or more selected strings and one or more unselected strings. In one embodiment, the string selector module includes a mechanical arm that pivots about a pivot point. In a certain embodiment, a portion of the mechanical arm passes over the strings of the stringed instrument when the user positions the string selector module to select the one or more selected strings. In a further embodiment a sensor module includes a pickup that produces an electrical signal in response to vibration of the one or more selected strings. In some embodiments, the pickup is positioned on the mechanical arm to pass over the strings of the stringed instrument as the portion of the mechanical arm passes over the strings.

In one embodiment, a first amplification module amplifies the electrical signal from the sensor module. In a certain embodiment, a second amplification module amplifies a second electrical signal from one or more main sensors that produce the second electrical signal in response to vibration of the plurality of strings for the stringed instrument. In a further embodiment, an isolation transformer module isolates an electrical ground for the first amplification module from an electrical ground for the second amplification module.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth; additional features and advantages of the invention described in a particular embodiment may be recognized in certain embodiments that may not be present in all embodiments. In other instances, well-known structures, materials, or operations are not shown or described in detail to avoid obscuring aspects of the invention.

The schematic block diagram in the Figures illustrates the architecture, functionality, and operation of possible implementations. It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Although various arrow types and line types may be employed in the flowchart and/or block diagrams, they are understood not to limit the scope of the corresponding embodiments. Indeed, some arrows or other connectors may be used to indicate only an exemplary logical flow of the depicted embodiment. The description of elements in each figure may refer to elements of proceeding figures. Like numbers refer to like elements in all figures, including alternate embodiments of like elements.

Figure 1:
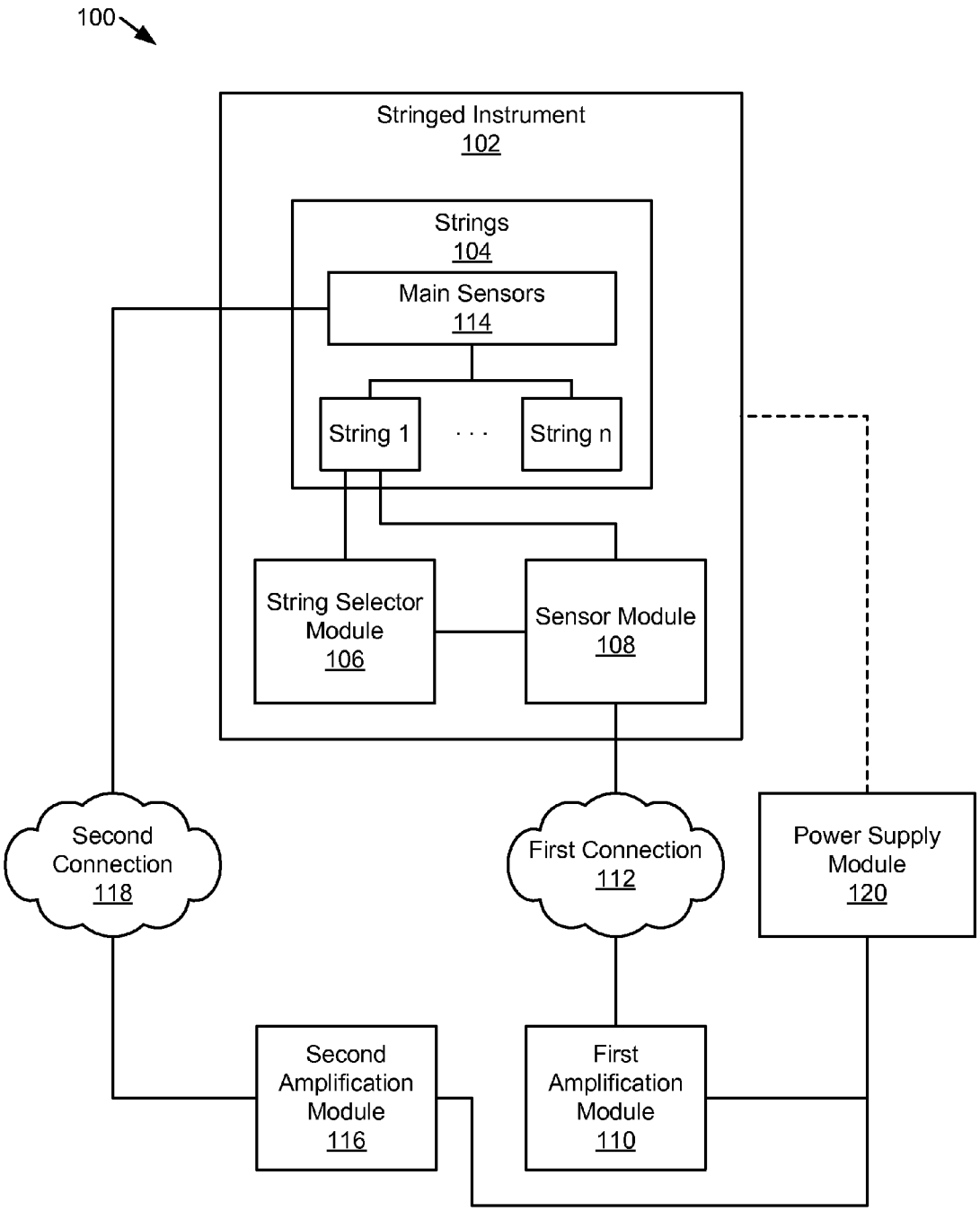
FIG. 1 is a schematic block diagram illustrating one embodiment of a system for movable sensing for stringed instruments.

FIG. 1 is a schematic block diagram depicting one embodiment of a system 100 for movable sensing for stringed instruments. The system 100 includes a stringed instrument 102 with a plurality of strings 104 (depicted as string 1 to string n), a string selector module 106, a sensor module 108 connected to a first amplification module 110 through a first connection 112, one or more main sensors 114 connected to a second amplification module 116 through a second connection 118, and a power supply module 120, which are described below.

The system 100 includes a stringed instrument 102 with strings 104 for making music. The stringed instrument 102 may be embodied in a guitar, bass guitar, steel guitar, banjo, mandolin, dulcimer, ukulele, violin, viola, cello, string bass, and/or any other instrument that includes one or more strings 104 that may be plucked, strummed, struck, and/or drawn across with a bow. Additionally, the foregoing embodiments of the stringed instrument 102 may be electric and/or acoustic. Typically electric stringed instruments include means to electrically sense the vibrating strings. A stringed instrument 102 that is acoustic may be designed to produce sound without electrical amplification, but may also include means for amplifying vibrations from the strings 104 of the stringed instrument 102. The stringed instrument 102 may also include one or more of various attachments, such as a vibrato bar, a wash-wash pedal, a capon, and other attachments. One of skill in the art will recognize other embodiments of the stringed instrument 102 not described herein that may produce sound. Similarly, one of skill in the art will recognize other means by which a user may elicit sound from the stringed instrument 102.

In one embodiment, the system 100 includes a string selector module 106 that selects one or more strings 104 of a stringed instrument 102 in response to a user of the stringed instrument 102 positioning at least a portion of the string selector module 106 over the one or more selected strings 104. In one embodiment, the plurality of strings 104 for the stringed instrument may include the one or more strings 104 selected by the string selector module, and one or more unselected strings 104. For example, the one or more selected strings 104 may be a proper subset of the total number of strings 104 (e.g. An strings) of the stringed instrument 102, leaving one or more other strings 104 unselected. In general, in various embodiments, selecting one or more strings 104 may refer to moving a sensor module 108, activating a portion of a sensor module 108, or the like, so that the sensor module 108 produces an electrical signal (as described below) in response to vibration of the selected strings 104, with less response, or no response, to vibration of the unselected strings 104. In one embodiment, the user positions the string selector module 106 while playing the stringed instrument 102. For example, the use may position the string selector module 106 in real time during a performance and may vary the position of the string selector module 106 to achieve different musical effects.

In one embodiment, the string selector module 106 is affixed to the stringed instrument 102. For example, the string selector module 106 may be affixed to stringed instrument 102 by using a screw, a clamp, a suction cup, or the like. In another embodiment, the stringed instrument 102 is manufactured with the string selector module 106. The stringed instrument 102 may also be manufactured with the sensor module 108. For example, in one embodiment, a string selector module 106 and a sensor module may be built into an electric guitar, an electric bass, or the like. In a certain embodiment, however, the string selector module 106 and the sensor module 108 may be provided separately from the stringed instrument 102. For example, in another embodiment, a user may obtain a string selector module 106 and a sensor module 108 as a kit for use with a separate stringed instrument 102. Connection of the string selector module 106 is discussed below with respect to various embodiments. One skilled in the art will recognize other means of attachment that are not mentioned herein but that substantially accomplish affixing the string selector module 106 to the stringed instrument 102.

In one embodiment, a user positions at least a portion of the string selector module 106 over the one or more selected strings 104 to select the one or more strings 104. For example, the user may position at least a portion of the string selector module over the one or more selected strings 104 by using at least a portion of the user's hand. In another example, the string selector module 106 may be attached to the user by means of a strap in such a way that the user may position at least a portion of the string selector module 106 over the one or more selected strings 104. The string selector module 106, in various embodiments, may be strapped to a user's hand, wrist, arm, etc. Other means of positioning at least a portion of the string selector module 106 over the one or more selected strings 104 not mentioned herein may be conceived of by one skilled in the art.

The plurality of strings for the stringed instrument 104 may include the one or more selected strings 104, and one or more unselected strings 104. The number of selected strings 104 may be less than a total number of strings 104 of the stringed instrument 102. For example, in one embodiment, the stringed instrument 102 may include up to (n) total strings 104. In one example, the stringed instrument 102 is a six string guitar. The user may position at least a portion of the string selector module 106 over the one or more strings 104, and the string selector module 106 may select up to (n-1) strings 104. Typically, the string selector module 106 selects one string 104 or possibly two strings 104 or even three strings 104. One skilled in the art will recognize other embodiments that substantially accomplish the purpose of using the string selector module 106 to select less than the total number of strings 104 of the stringed instrument 102. Various embodiments of the string selector module 106 are described below.

The system 100, in one embodiment, includes a sensor module 108 that produces an electrical signal in response to vibration of the one or more selected strings 104. For example, in various embodiments, the sensor module 108 may include a pickup that produces an electrical signal in response to vibration of the one or more selected strings 104, such as an electromagnetic pickup, a piezoelectric pickup, an electrostatic pickup, a an optical pickup, or the like. In further embodiments, the sensor module 108 may include a housing, a cover, a mounting plate, attachment points, electrical connections, or the like, for the pickup. The sensor module 108 may produce the electrical signal in response to the string selector module 106 selecting the one or more strings 104. In one embodiment, the sensor module 108 is located proximate to the one or more selected strings 104 when the sensor module 108 produces an electrical signal in response to vibration of the one or more selected strings 104. In one embodiment, a detection range for the sensor module 108 to respond to vibrations produced by the one or more selected strings 104 may be fixed at a distance. In a further embodiment, the sensor module 108 may move over the strings 104 of the stringed instrument 102 at a fixed distance from the strings 104. In a further embodiment, the fixed distance between the strings 104 and the sensor module 108 may be based on the fixed detection range of the sensor module 108.

In one embodiment, the fixed distance may be a distance that is related to distance between the strings 104 or may be a distance that is related to design of the sensor module 108. For example, if a distance between strings is 0.4 inches, the sensor module 108 may be designed to pick up sound from a string 104 for some distance related to the 0.4 inches. If the sensor module 108, for example, is designed to pick up sound of a single string 104 (e.g. String 1), the sensor module 108 may pick up sound when positioned within 0.2 inches from the string 104 so that sound from an adjacent string 104 (e.g. String 2) is greatly attenuated when the sensor module 108 is positioned over string 1. In other embodiments, the sensor module 108 is designed to pick up sound at a greater range to facilitate selection of two or more strings for a particular sensor module 108 position. In other embodiments, the sensor module 108 has a range of pickup of string vibrations. One of skill in the art will recognize other detector ranges within which the sensor module 108 may detect the sound produced by the one or more strings 104.

In one embodiment, the sensor module 108 includes one or more circuits and devices that convert vibrations of the selected strings 104 (whether detected directly by sensing movement of the strings or indirectly by sensing movement of a sound board, air pressure variations, or the like) to an electronic signal suitable for transmission to another device for amplification. For example, the sensor module 108 may include circuits, devices, a jack, or other components known to those of skill in the art to condition a sound signal to a signal type similar to typical electric guitars or other stringed instrument 102 with amplification. The sensor module 108, in one embodiment, includes a jack or other connector suitable for connecting the stringed instrument 102 to an amplifier, a sound board, a mixer, etc. For example, the sensor module 108 may produce an analog voltage signal. The voltage signal, in one embodiment is between approximately 100 millivolts ("mV") rms (root-mean-square) to over 1 V rms. Other sensor modules may produce a voltage signal up to around 5 V rms, for example for a single coil, to around 10 V rms, for example for a dual coil pickup. In another embodiment, the sensor module 108 produces a digital output signal. For example, if the output signal from the sensor module 108 is a wireless signal, the output signal may be digital. One of skill in the art will recognize other forms and types of output signals suitable for the output of the sensor module 108.

In general, in various embodiments, musical effects may be created while playing the stringed instrument 102 by moving the sensor module 108 relative to the strings 104, or by selecting different strings 104 (by re-positioning the string selector module 106). In certain embodiments, a user may manipulate the string selector module 106 and/or the sensor module 108 in real-time, during a performance, to affect the signal from the sensor module 108, and thereby vary the sound of the stringed instrument 102.

In one embodiment, the system 100 includes a first amplification module 110 that amplifies the electrical signal from the sensor module 108. In one embodiment, the first amplification module 110 may include an amplifier. In a further embodiment, the first amplification module 110 may include a loudspeaker that converts the amplified electrical signal to transmitted sound waves. The sensor module 108 typically detects vibrations of the one or more strings 104 and transmits an electrical signal to the first amplification module 110 for amplification. The first amplification module 110 amplifies the electrical signal from the sensor module 108, and translates the amplified electrical signal to a sound wave. The sensor module 108, in one embodiment, is an analog pickup that converts string vibrations into an analog electrical signal. In another embodiment, the sensor module 108 is digital and converts string vibrations to a digital signal. The sensor module 108 and/or first amplification module 110 may include a sound board, a mixer, a digital signal processor, or other devices known to those of skill in the art for converting string vibrations to sound waves.

In one embodiment, the sensor module 108 transmits an electrical signal, either analog or digital, to the first amplification module 110 via a first connection 112. The first connection 112 may be wired and/or wireless. For example, where the first connection 112 is wireless, the sensor module 108 may convert sound produced by the one or more strings 104 to a wireless signal. The first amplification module 110 may include a receiver that receives the wireless signal from the sensor module 108. In another embodiment, the sensor module 108 transmits a wireless signal and a sound board, mixer, etc. receives the wireless signal and processes the wireless signal before transmission to the first amplification module 110. Where the first connection 112 is a wired connection, the sensor module 108 may include one or more electrical components capable of transmitting a signal corresponding to sound detected from the one or more strings 104 to the first amplification module 110, including an amplifier and/or any other intervening equipment. One of skill in the art will recognize other ways for the sensor module 108 to transmit a sound signal over the first connection 112 to the first amplification module 110.

In some embodiments of the system 100, the stringed instrument 102 may include one or more main sensors 114 that produce a second electrical signal in response to vibration of the plurality of the strings 104 of the stringed instrument 102, separate from the vibration of the selected strings 104 detected by the sensor module 108. For example, the main sensors 114 may be configured to detect the sound produced by all of the strings 104 of the stringed instrument 102. In various embodiments, the one or more main sensors 114 may include one or more pickups, one or more microphones, a combination of pickups and microphones, or the like. In one embodiment, the electrical signal produced by the sensor module 108 differs from the second electrical signal produced by the main sensors 114. One of skill in the art will recognize various ways of producing an electrical signal in response to vibration of the plurality of strings 104.

In one example, the main sensors 114 transmit signals to a second amplification module 116 over the second connection 118. In various embodiments, the second amplification module 116 may be similar to one or more embodiments described above for the first amplification module 110. In one embodiment, the second amplification module 116 amplifies the electrical signal from the main sensors 114. In a further embodiment, the second amplification module 116 may include a loudspeaker that produces sound based on the amplified electrical signal The main sensors 114 and second amplification module 116, in one embodiment, are prior art means for producing and amplifying a signal from the stringed instrument 102 while the sensor module 108 and first amplification module 110 complement sound produced through the main sensors 114 and second amplification module 116. Adding a string selector module 106, sensor module 108, and first amplification module 110 to a stringed instrument 102 with main sensors 114 and second amplification module 116, in one embodiment, produces a different effect than a typical stringed instrument 102 with amplification.

The second connection 118, in one embodiment, is similar to the first connection 112 and may be wired or wireless. As with the sensor module 108, first amplification module 110, and first connection 112, the main sensors 114 and accompanying second amplification module 116 and second connection 118 may include typical sound components, such as a mixer, a sound board, a digital signal processor, etc. In one embodiment, the sensor module 108, first amplification module 110, first connection 112, main sensors 114, accompanying second amplification module 116 and second connection 118 share some equipment. For example, the main sensors 114 and sensor module 108 may send signals to a mixer that then sends signals to the first and second amplification modules 110, 116.

Some embodiments of the first amplification module 110 and/or second amplification module 116 may include one or more speakers, which may be connected to a sound board, audio power amplifiers, a sound recording device, headphones, a sound modulator, etc. One skilled in the art will recognize other means that substantially accomplish producing and/or modifying the sound detected by the sensor module 108 and/or main sensors 114.

The embodiments mentioned above with respect to the first amplification module 110 and/or second amplification module 116 may also be combined into other embodiments. For example, the user may listen to the sound detected by the sensor module 108 and/or main sensors 114 through headphones while the sound detected is also recorded by a sound recording device. Similarly, the sound detected by the sensor module 108 and/or main sensors 114 may be amplified by an audio power amplifier while the sound detected is also recorded by a sound recording device. Other means of combining embodiments of the first amplification module 110 and/or second amplification module 116 not described herein may be recognized by one skilled in the art.

The first amplification module 110 may be positioned with respect to the second amplification module 116 so as to affect a combined sound jointly produced by the first amplification module 110 and second amplification module 116. For example, the second amplification module 116 may amplify the sound detected by the main sensors 114, and the first amplification module 110 may amplify the sound detected by the sensor module 108. In such an embodiment, the second amplification module 116 may be positioned with respect to the first amplification module 110 so as to affect the phase relationship between the sound detected by the main sensors 114 and sound detected by the sensor module 108. The phase relationship, in one embodiment, may be manipulated by physical placement of the first and second amplification modules 110, 116. In another embodiment, the phase relationship is manipulated electronically, for example by delaying a signal from the main sensors 114 or a signal from the sensor module 108. One skilled in the art will recognize other ways of positioning the first amplification module 110 and the second amplification module 116 with respect to each other so as to affect the combined sound jointly produced.

In another embodiment, phase relationships between the outputs of sensor module 108 and main sensors 114 may also be changed by moving the sensor module 108 relative to the strings 104. In certain embodiments, where the position of main sensors 114 is fixed relative to the position of the strings 104 and the sensor module 108 may be moved relative to the strings 104 (e.g., by changing the position of the string selector module 106), and since, phase relationship changes between the outputs of main sensors 114 and the sensor module 108 occur when the sensor module 108 is moved. The movement of the sensor module 108 relative to the strings 104, coupled with the output of main sensors 114 that may be fixed relative to the strings 104, may cause phase relationship changes to occur in the summed output of the main sensors 114 and the sensor module 108, regardless of whether the outputs are summed electronically in a circuit or acoustically after being routed through amplifiers connected to speakers.

In one embodiment, the first connection 112 and the second connection 118 may be independent wired or wireless connections. For example, in a certain embodiment, the first connection 112 and the second connection 118 may include separate mono cables. In another embodiment, the first connection 112 and the second connection 118 may be integrated wired or wireless connections. For example, in some embodiment, a single stereo cable may include separate channels for the first connection 112 and the second connection 118.

The system 100 may also include the power supply module 120 for providing power to the stringed instrument 102, string selector module 106, sensor module 108, first amplification module 110, second amplification module 116, etc. The power supply module 120 may include a wall outlet, a battery, a surge protector, a power generator, and/or other means of providing power. In the depicted embodiment, the stringed instrument 102, first amplification module 110, and second amplification module 116 are powered by the same power supply module 120. In another embodiment, the power supply module 120 includes multiple power supplies. In a certain embodiment, the power supply module 120 may provide power to first and/or second amplification modules 110, 116, but the stringed instrument 102, the string selector module 106 and/or the sensor module 108 may be unpowered.

In one embodiment, the sensor module 108 is attached or coupled to the string selector module 106 such that the sensor module 108 moves with the string selector module 106 when the user positions the string selector module 106 to select the one or more selected strings 104. Embodiments depicting the sensor module 108 coupled to the string selector module 106 are described below in more detail with respect to FIGS. 2, 3, and 6. In other embodiments, the sensor module 108 is connected indirectly to the string selector module 106, mechanically or electrically. One embodiment of an electrical connection is described in conjunction with FIG. 4. An indirect connection between the string selector module 106 and sensor module 108 is described in relation to FIG. 5.

Figure 2:
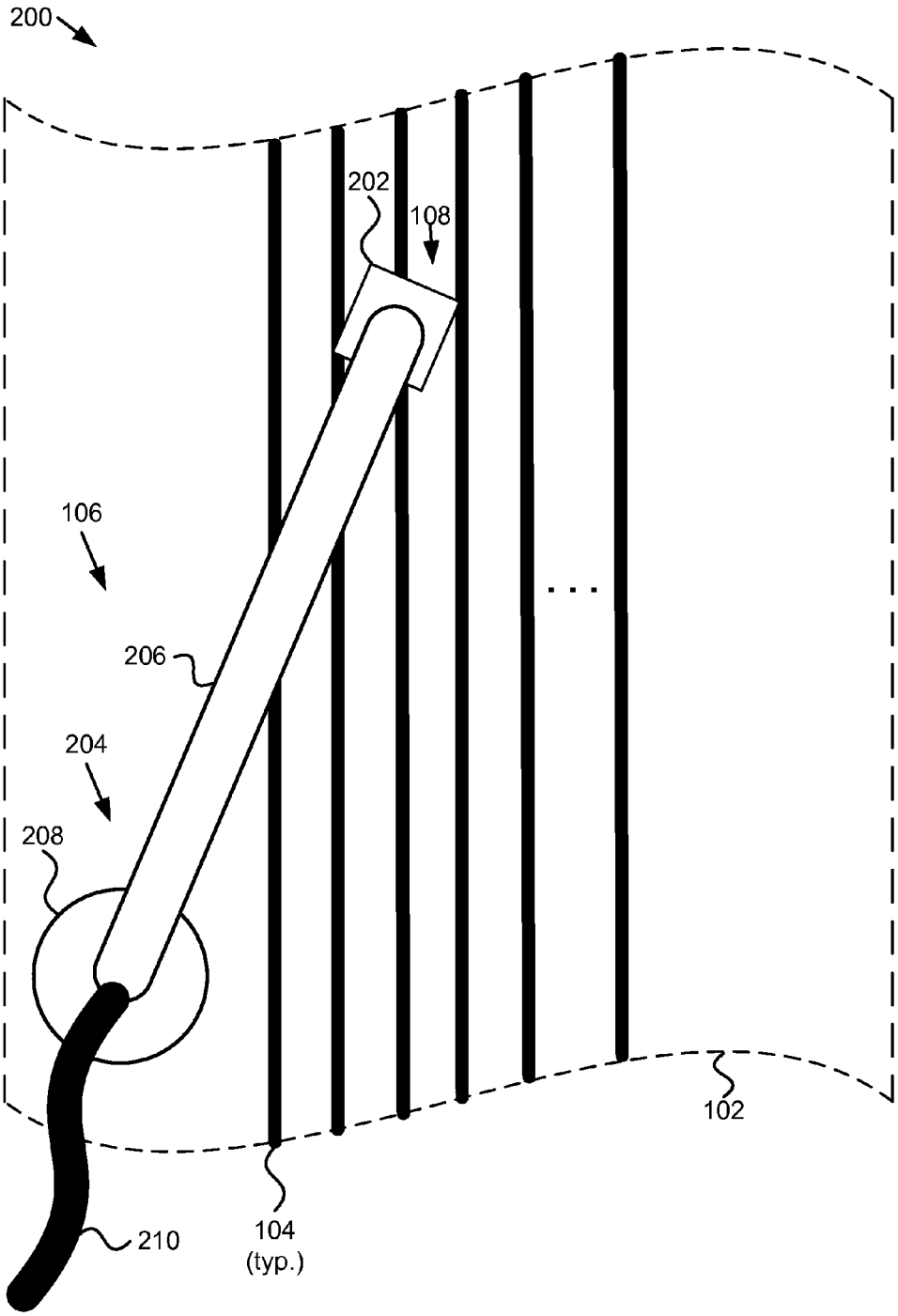
FIG. 2 is a top view illustrating one embodiment of an apparatus for movable sensing for stringed instruments.

FIG. 2 depicts one embodiment of an apparatus 200 for movable sensing for stringed instruments. The apparatus 200 is one embodiment of the system 100 of FIG. 1. The apparatus 200 includes a sensor module 108 attached to a string selector module 106 and the sensor module 108 moves with the string selector module 106 when a user positions the string selector module 106 to select the one or more strings 104. In one embodiment, the sensor module 108 includes a pickup 202 and the string selector module 106 includes a mechanical device 204 where a portion of the mechanical device 204 passes over the strings 104 of the stringed instrument 102. The pickup 202 is positioned on the mechanical device 204 to pass over the strings 104 (e.g. String 1 to string n) of the stringed instrument 102 as the portion of the mechanical device 204 passes over the strings 104.

In one embodiment, the mechanical device 204 includes a mechanical arm 206 that pivots about a pivot point 208. In a certain embodiment, the arm 206 is connected to the stringed instrument 102 at the pivot point 208. In a further embodiment, a portion of the mechanical arm 206 passes over the strings 104 of the stringed instrument 102. For example, the portion of the mechanical arm 206 may pass over the strings 104 when the user positions the string selector module 106 to select the one or more selected strings 104. The pickup 202 is mounted to or otherwise positioned on the arm 206 to pass over the strings 104 of the stringed instrument 102 as the portion of the mechanical arm 206 passes over the strings 104. For example, when a user positions the arm 206 over the strings 104, the pickup 202 also moves over the strings 104. A wired connection 210 connects the sensor module 108 through the string selector module 106 to the first amplification module 110.

The pickup 202, in some embodiments, includes a magnetic pickup, a piezoelectric pickup, a wireless pickup, etc. In the depicted embodiment, the arm 206 is connected to the pivot point 208 at one end, and another end of the arm 206 extends over the one or more strings 104. The pickup 202 may be positioned on the end of the arm 206 opposite the end connected to the pivot point 208. In such an embodiment, the pickup 202 may pass over the strings 104 of the stringed instrument 102 as at least a portion of the arm 206 passes over the strings 104.

In some embodiments of the mechanical device 204, the arm 206 may be collapsible and/or have an adjustable length. For example, the arm 206 may be telescopic, may fold in on itself, and/or may slide over the pivot point such that the portion of the arm 206 over the one or more strings 104 of the stringed instrument 102 may be increased and/or decreased. One skilled in the art will recognize other embodiments that allow collapsing and/or adjusting the length of the arm 206.

Figure 8:
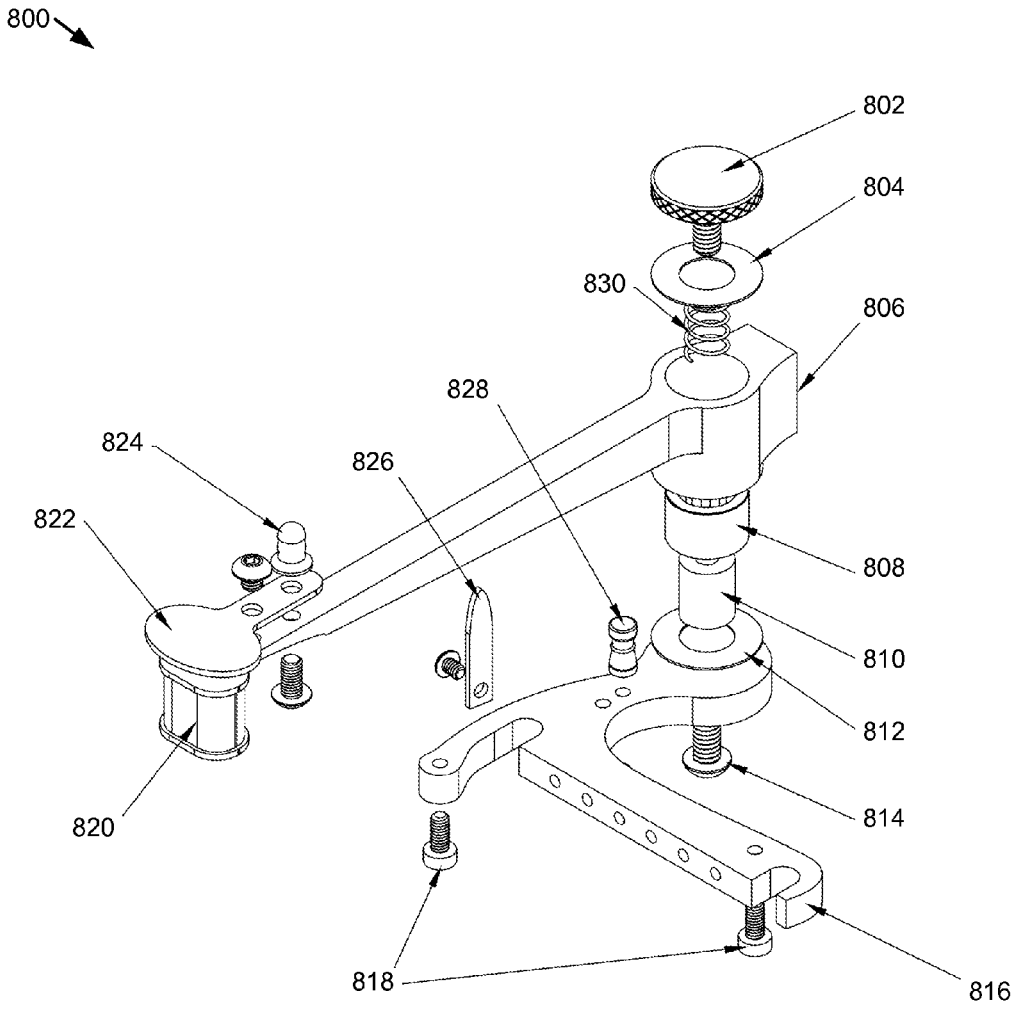
FIG. 8 is an exploded perspective view illustrating another embodiment of an apparatus for movable sensing for stringed instruments.
Figure 9:
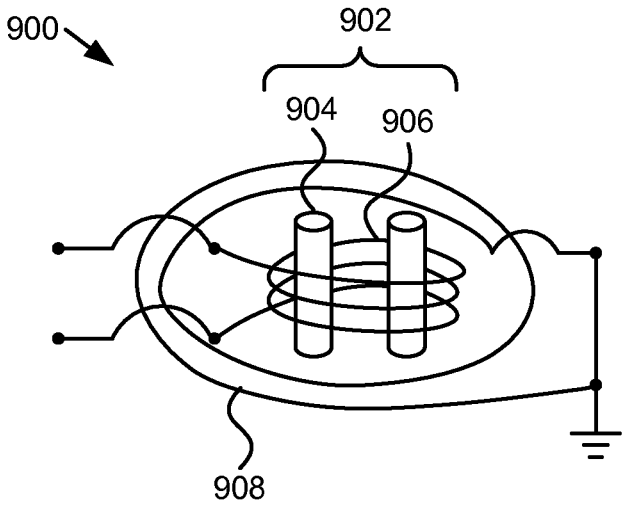
FIG. 9 is an electrical schematic diagram illustrating one embodiment of a sensor module.

In one embodiment, the mechanical device 204 is built into the stringed instrument 102. For example, the pivot point 208 may be recessed into the body of the stringed instrument 102. Wiring from the pickup 202 may run through the arm 206 and through the pivot point 208 to a jack within the stringed instrument 102. In another embodiment, the mechanical device 204 is detachable from the stringed instrument. For example, the mechanical device 204 may replace the tailpiece of the stringed instrument 102. In various embodiments, the mechanical device 204 is connected with straps, clamps, etc. to the stringed instrument. One particular embodiment is shown in FIGS. 7-9.

Figure 3:
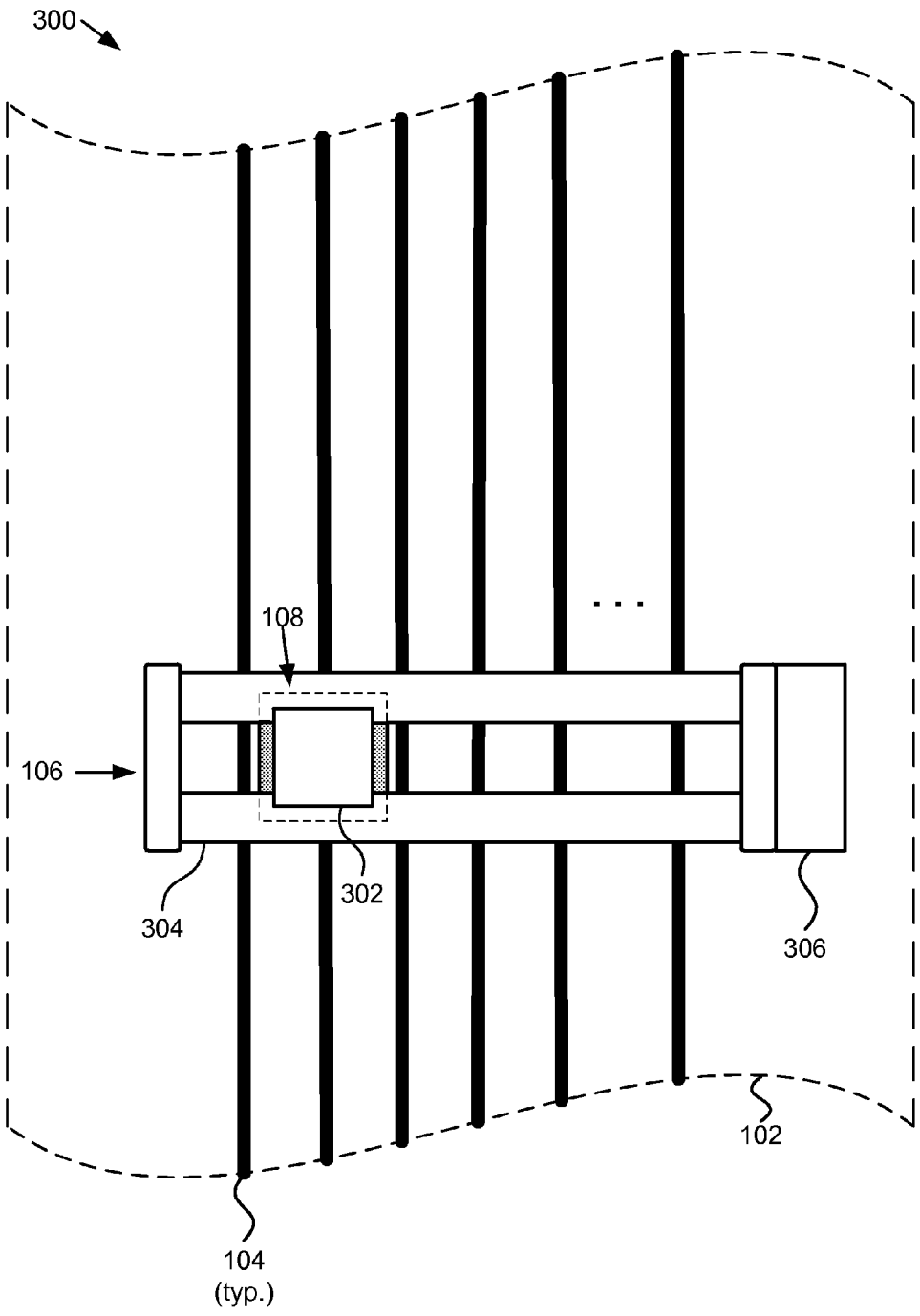
FIG. 3 is a top view illustrating another embodiment of an apparatus for movable sensing for stringed instruments.

FIG. 3 is a top view drawing illustrating another embodiment of an apparatus 300 for movable sensing for stringed instruments, in accordance with an embodiment of the present invention. FIG. 3 depicts one embodiment of the system 100 of FIG. 1 where the string selector module 106 includes a mechanical device with the sensor module 108 embodied as a slider 302 in a channel 304 positioned over the strings 104 of the stringed instrument 102. In the depicted embodiment, the slider 302 passes over the one or more strings 104 of the stringed instrument 102. In one embodiment, the slider 302 includes a pickup positioned such that the pickup passes over the one or more strings 104 of the stringed instrument 102 as the slider 302 passes over the one or more strings 104. In one embodiment, the sensor module 108 connects to the first amplification module 110 through wiring and other physical electrical pathways that pass through the slider 302, channel 304, etc. and may connect to a jack in the stringed instrument 102. The depicted embodiment includes a wireless connection 306 that connects the sensor module 108 to the first amplification module 110 through the string selector module 106.

Figure 4:
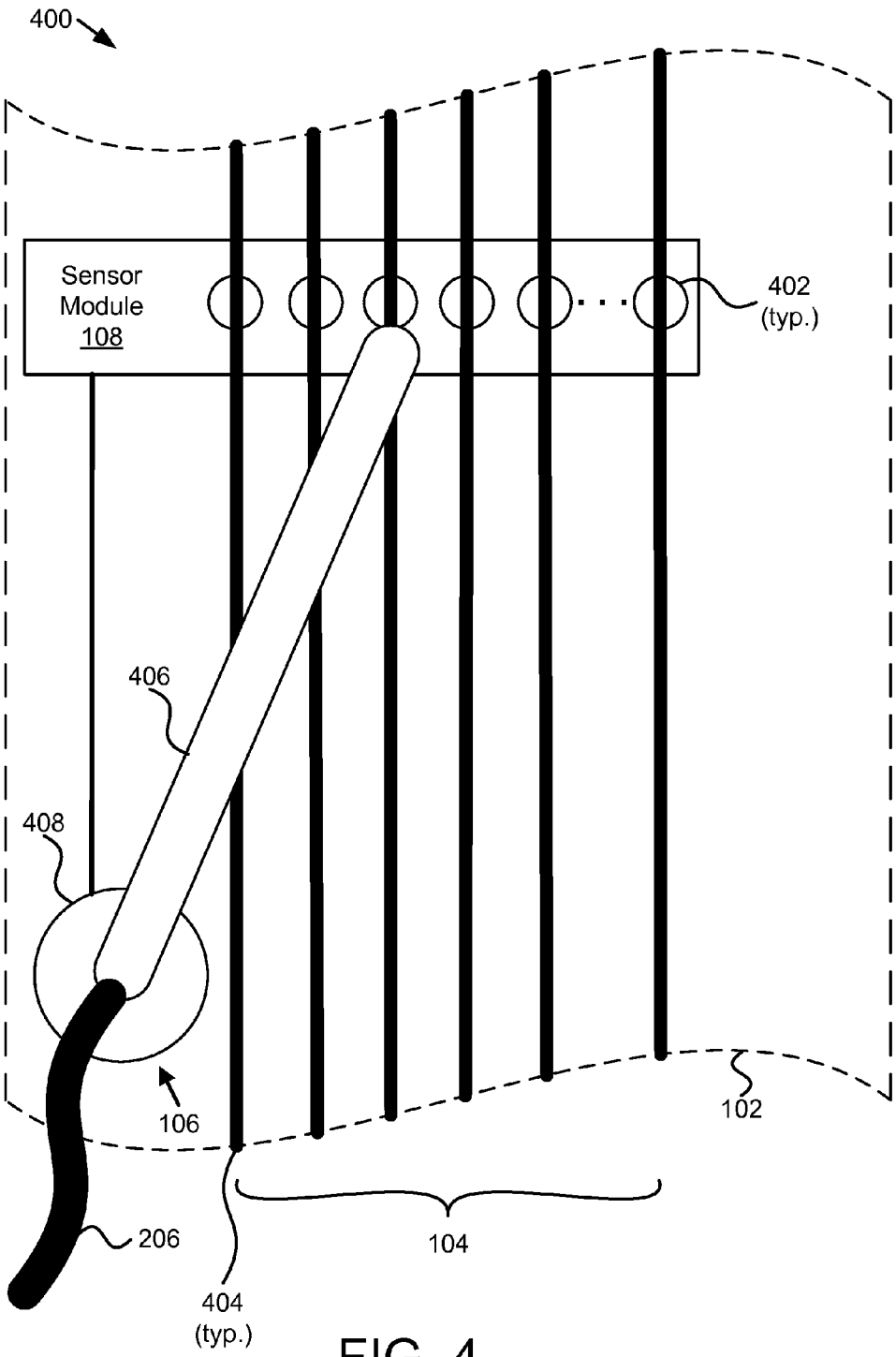
FIG. 4 is a top view illustrating yet another embodiment of an apparatus for movable sensing for stringed instruments.

FIG. 4 is a top view drawing illustrating yet another embodiment of an apparatus 400 for movable sensing for stringed instruments. FIG. 4 depicts another embodiment of the system 100 of FIG. 1. In the depicted embodiment, the sensor module 108 includes a pickup 402 for each of the one of more strings 104 of the stringed instrument 102 to detect sound for a respective string 404 of the stringed instrument 102 in response to the string selector module 106 being positioned to correspond to the respective string 404. The string selector module 106, in the depicted embodiment, is positioned external to the stringed instrument 102, and includes a mechanical device 406, depicted in FIG. 4 as an arm, and a position sensor 408. At least a portion of the mechanical device 406 may pass over the one or more of the respective strings 404 to select one respective string 404. In one embodiment, the string selector module 106 includes a position for each respective string 404 of the stringed instrument 102.

In one embodiment, the position sensor 408 determines a position of the mechanical device 406 with respect to the respective string 404. The string selector module 106 may select the pickup 402 associated with the respective string 404 corresponding to the position of the mechanical device 406 as determined by the position sensor 408. Further, the string selector module 106 may activate the pickup 402 corresponding to the respective string 404. Similarly, in another embodiment, the position sensor 408 determines a position of the mechanical device 406 relative to the plurality of strings 404 of the stringed instrument 102, and the string selector module 106 activates the pickups 402 corresponding to the selected strings 404. In such an embodiment, the plurality of respective strings 404 includes a subset of less than the total number of respective strings 404 of the stringed instrument 102.

In one embodiment, the position sensor 408 includes a sensor that produces a unique signal for each string position. For example, the position sensor 408 may include a discrete step for each string 104. In one embodiment, each discrete step corresponds to a digital signal sent to the sensor module 108. In another embodiment, the position sensor 408 provides an analog signal where a particular value or range of values of the analog signal correspond to a string 104. For example, the position sensor 408 may include a potentiometer and moving the mechanical device 406 changes resistance in the position sensor 408 to affect a voltage output of the position sensor 408. In another embodiment, the position sensor 408 is adjustable so that a user may customize a position of the mechanical device 406 for each string 104 or so that the position sensor 408 may be calibrated. One of skill in the art will recognize other ways to implement a position sensor 408 that provides a unique signal for each string position.

The sensor module 108, in one embodiment, includes a signal processor, such as a multiplexer, that activates a pickup 402 for a particular string 404 in response to receiving a particular signal from the position sensor 408. In one embodiment, the signal processor processes digital signals from the position sensor 408 and activates a particular pickup 402 for a corresponding digital signal. In another embodiment, the signal processor is an analog processor that receives an analog signal from the position sensor 408 and activates a particular pickup 402 in response to a particular voltage level. In one embodiment, the string selector module 106 and/or the sensor module 108 may be coupled (directly or indirectly) to a vibrato arm (not shown), commonly known as a whammy bar. In a further embodiment, the vibrato arm exerts control over vibrato effects for the stringed instrument 102 while at the same time its movement around its pivot point, substantially similar to the movement of the mechanical arm 206 around the pivot point 208 in FIG. 2, also controls the sensor module 108 which, in conjunction with a signal processor, determines the output of pickup(s) 402. One of skill in the art will recognize other ways to implement a signal processor in the sensor module 108 to activate a pickup 402 in response to a particular signal from the position sensor 408.

Figure 5:
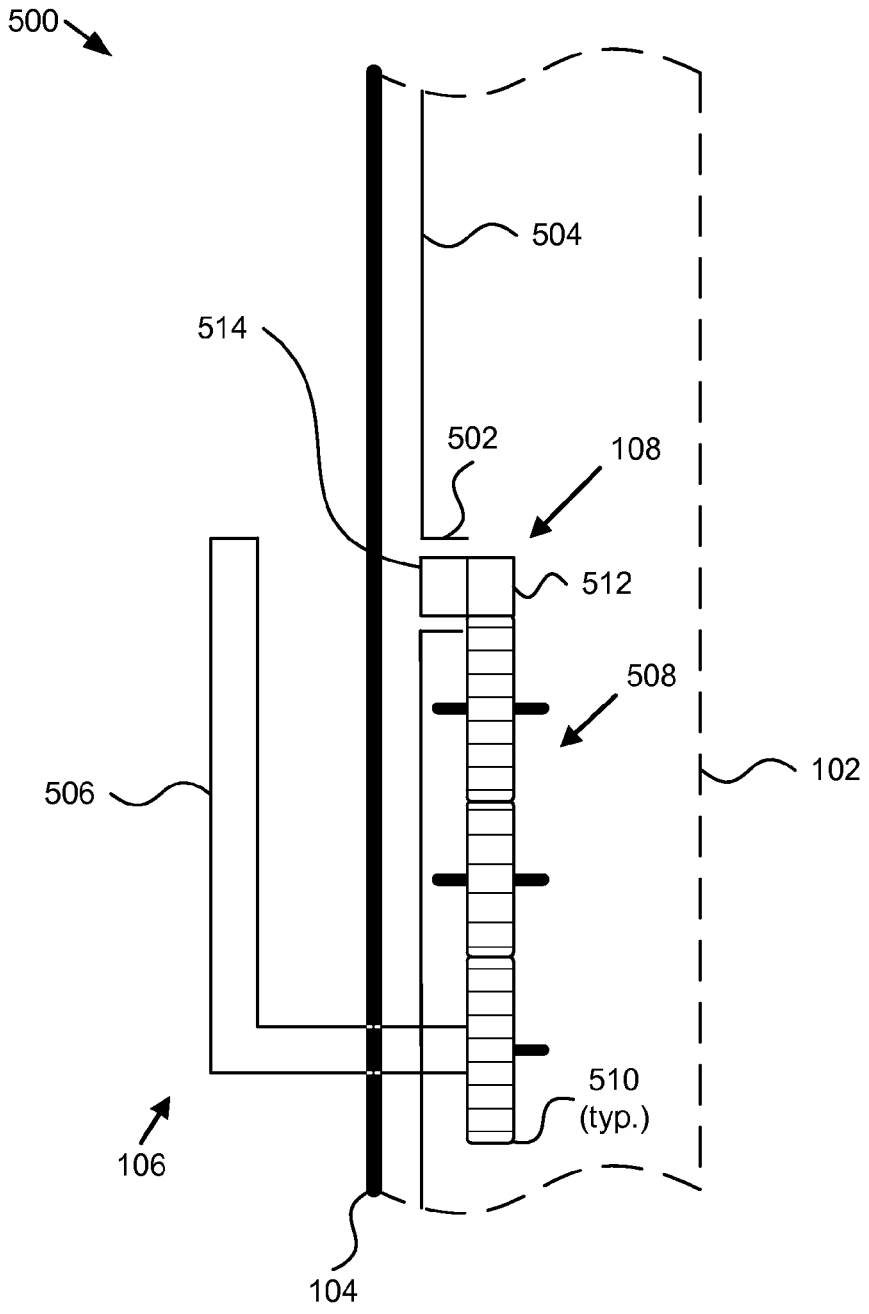
FIG. 5 is a side view depicting another embodiment of an apparatus for movable sensing for stringed instruments.

FIG. 5 is a side view drawing depicting another embodiment of an apparatus 500 for movable sensing for stringed instruments. FIG. 5 represents one embodiment of the system 100 of FIG. 1. In the depicted embodiment, the string selector module 106 is positioned external to the stringed instrument 102 and is configured to pass over the strings 104. The sensor module 108, in the depicted embodiments, is positioned within the stringed instrument 102 at a location between the strings 104 and a center of the stringed instrument 102. Similar to other depicted embodiments, movement of the string selector module 106 to pass over the strings 104 causes movement of the sensor module 108. However, in the embodiment of FIG. 5, the sensor module 108 moves underneath the strings 104, and a position of the string selector module 106 relative to the strings 104 positions the sensor module 108 under the strings 104.

In one embodiment, the sensor module 108 includes a pickup 514, which is positioned in a slot 502 in a face 504 of the stringed instrument 102 such that the sensor module 108 is exposed to the strings 104. The string selector module 106 may include an arm 506. Movement of the string selector module 106 may cause movement of the sensor module 108 by an indirect coupling mechanism 508. The indirect coupling mechanism 508 may move the sensor module 108 in response to detecting movement of the string selector module 106. The indirect coupling mechanism may include a set of gears and/or pulleys, a servomotor, etc. For example, the arm 506 may be directly coupled to one of a set of gears 510, such that when the arm 506 is rotated, the gears rotate. The sensor module 108 may include a component such as a toothed belt 512 that interfaces with the gears 510. As the user rotates the arm 506, the gears 510 rotate, thereby rotating the toothed belt, and moving the sensor module 108 along the slot 502. In another example, the arm 506 is connected to a controller such as an encoder, and the sensor module 108 is coupled to a servomotor. The encoder may detect a position of the arm 506 by means such as a potentiometer, and may send a signal to the servomotor in response to detecting the position of the arm 506. The servomotor may then position the sensor module 108 corresponding to the position of the arm 506. One skilled in the art will recognize other means of indirectly coupling that substantially accomplish moving the sensor module 108 in response to detecting movement of the string selector module 106.

Figure 6:
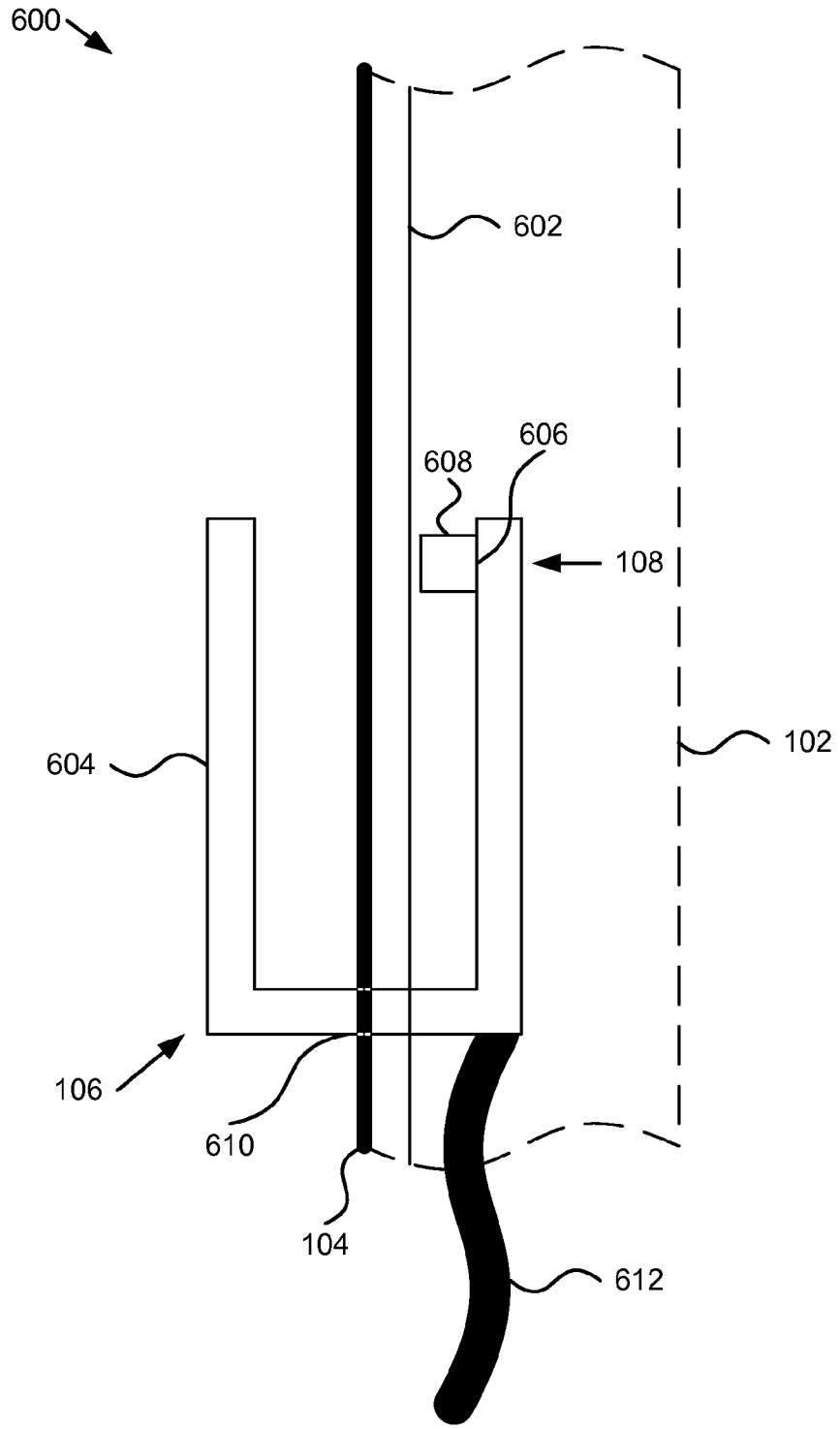
FIG. 6 is a side view illustrating another embodiment of an apparatus for movable sensing for stringed instruments.
Figure 7A:
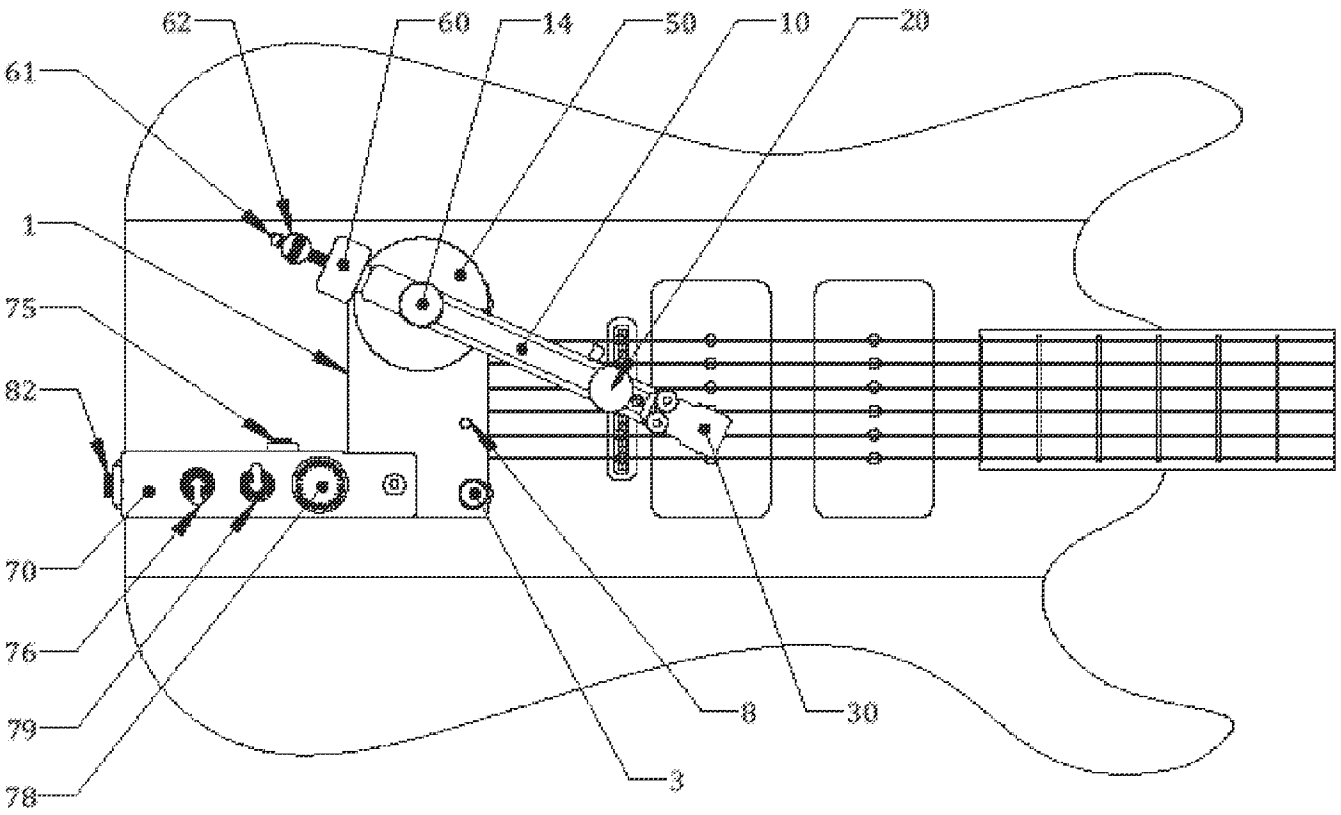
FIG. 7A is a top view illustrating another embodiment of an apparatus for movable sensing for stringed instruments.
Figure 7B:
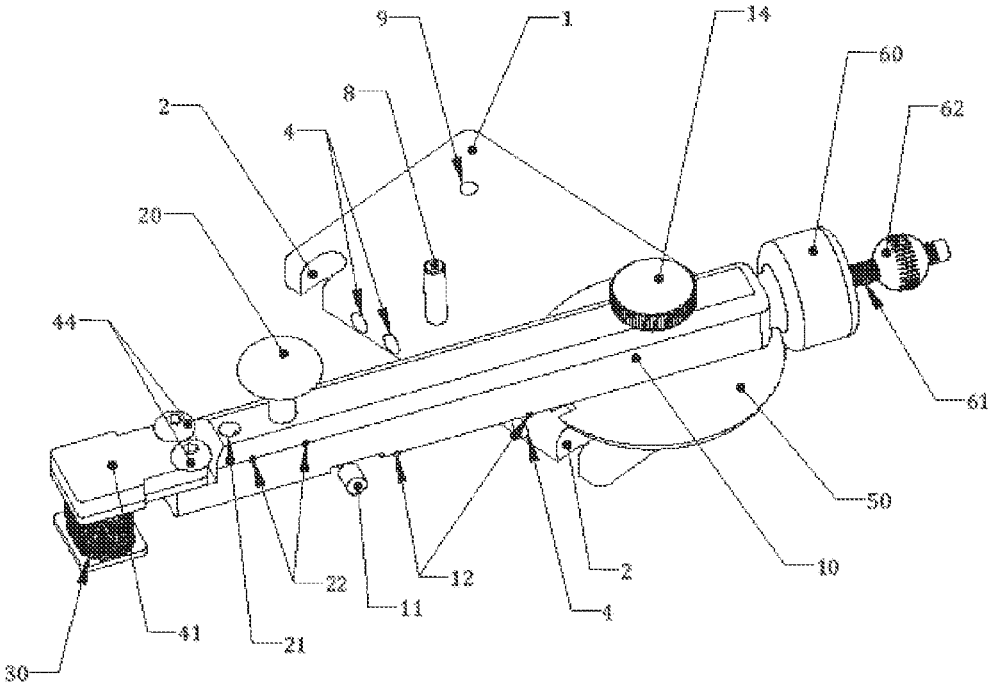
FIG. 7B is a perspective view illustrating a portion of the apparatus depicted in FIG. 7A.
Figure 7C:
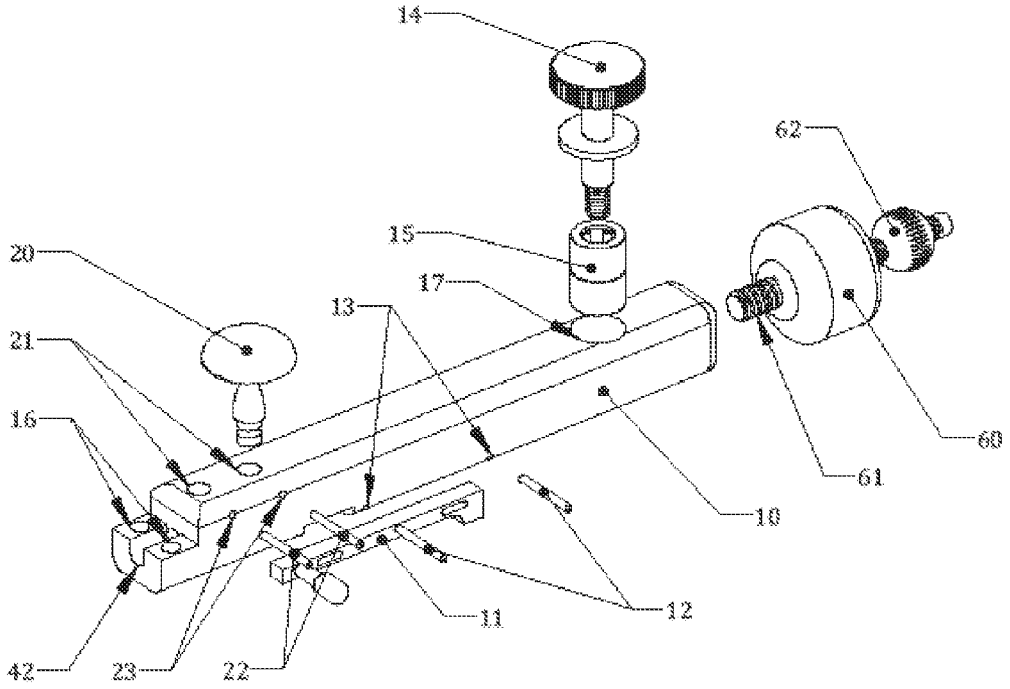
FIG. 7C is an exploded perspective view of a portion of the apparatus depicted in FIG. 7A.
Figure 7D:
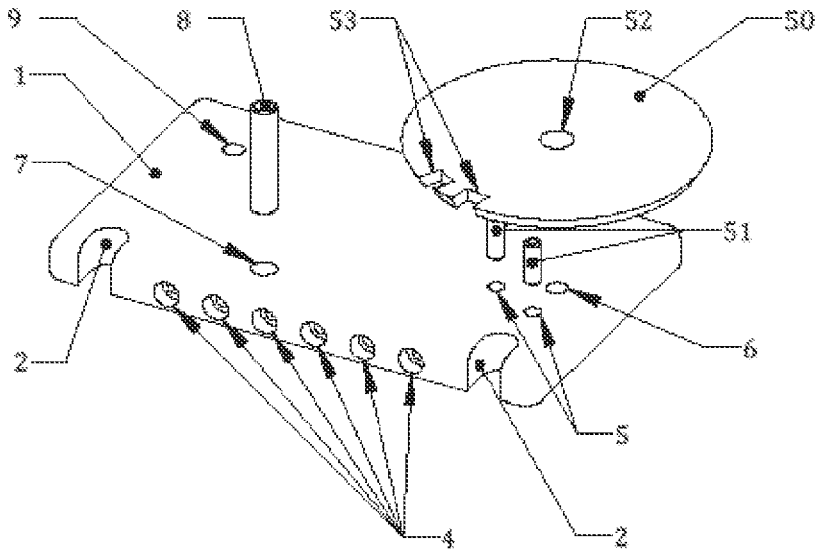
FIG. 7D is another exploded perspective view of a tailpiece portion of the apparatus depicted in FIG. 7A.
Figure 7E:
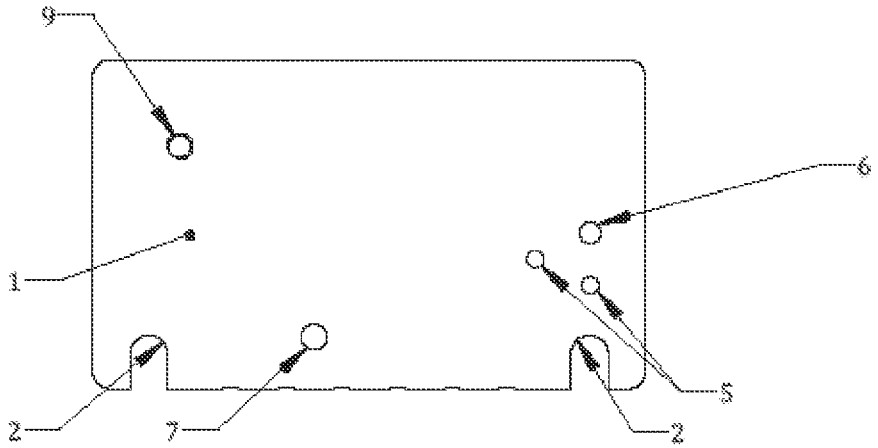
FIG. 7E is a top view of a portion of the apparatus depicted in FIG. 7A.
Figure 7F:
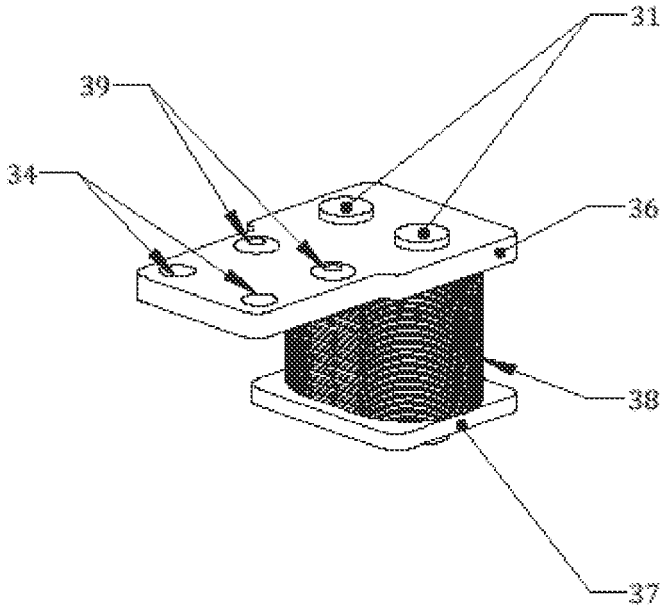
FIG. 7F is a perspective view of a pickup of the apparatus depicted in FIG. 7A.
Figure 7G:
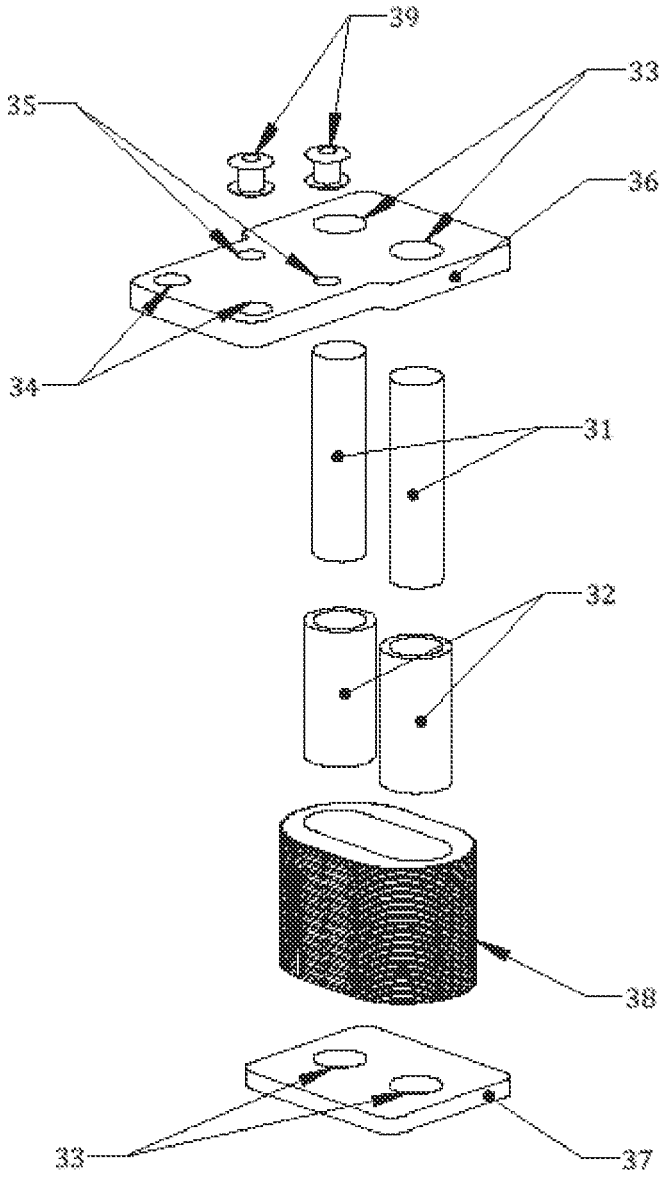
FIG. 7G is an exploded perspective view of the pickup of the apparatus depicted in FIG. 7A.
Figure 7H:
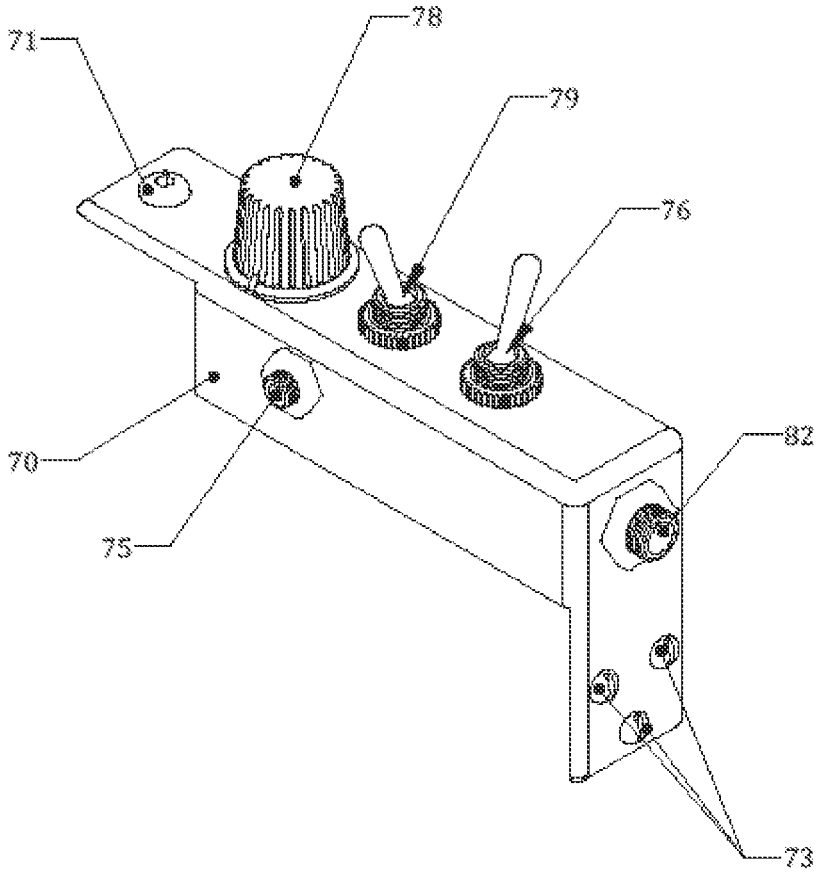
FIG. 7H is a perspective view of a control module of the apparatus depicted in FIG. 7A.
Figure 7I:
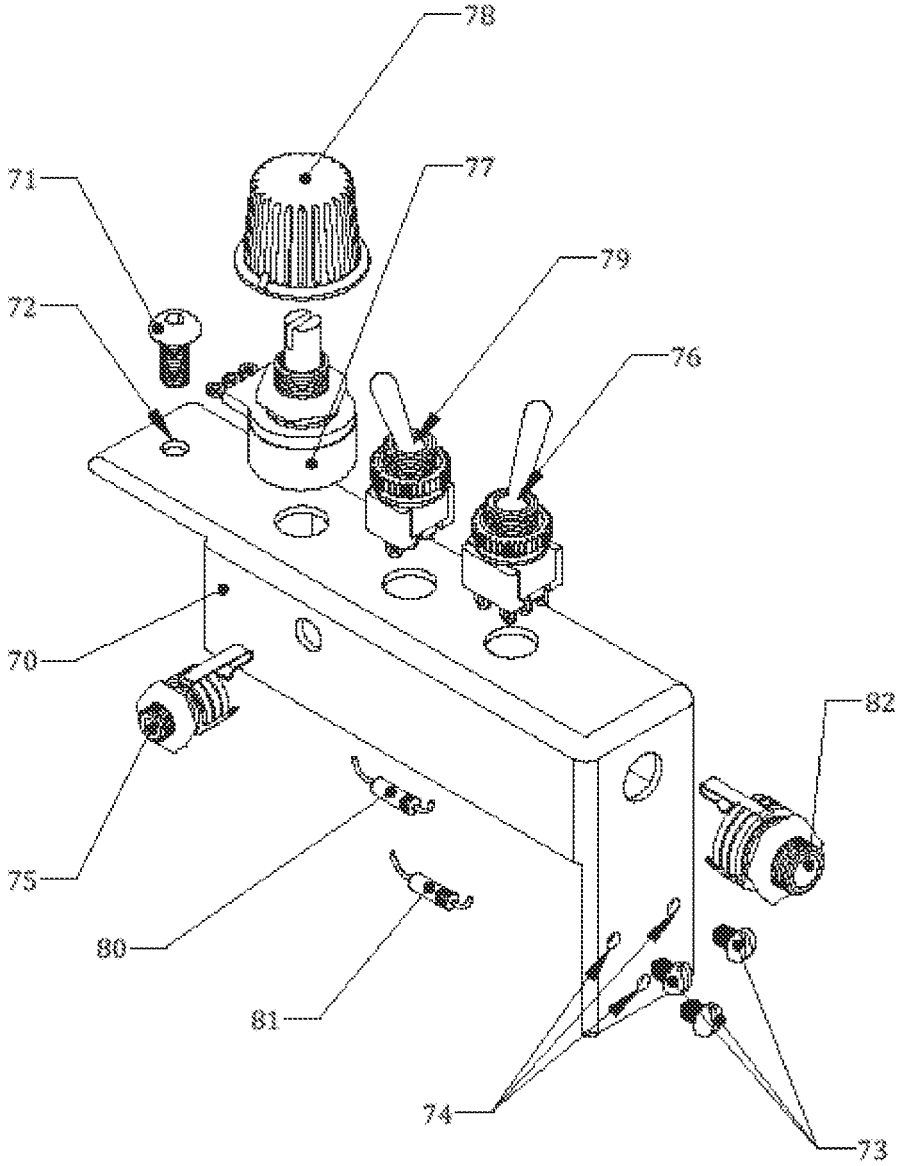
FIG. 7I is an exploded perspective view of the control module of the apparatus depicted in FIG. 7H.

FIG. 6 is another side view drawing illustrating an apparatus 600 for movable sensing for stringed instruments in accordance with another embodiment of the present invention. FIG. 6 depicts another embodiment of the system 100 of FIG. 1. Similar to FIG. 5, the sensor module 108 is positioned between the strings 104 and the center of the stringed instrument 102. The sensor module 108 may be positioned under a face 602 of the stringed instrument 102 such that the face 602 is positioned between the one or more strings 104 of the stringed instrument 102 and the sensor module 108. In one embodiment, the string selector module 106 includes an arm 604. The arm 604 may include a first portion positioned substantially horizontally above the strings 104, a second portion passing substantially vertically through the face 602, and a third portion positioned substantially horizontally between the face 602 and the center of the stringed instrument 102.

Movement of the string selector module 106 may cause movement of the sensor module 108, with a pickup 608, by a direct coupling mechanism 606 that directly connects the string selector module 106 to the sensor module 108. For example, the direct coupling mechanism 606 may include a U-shaped arm 604 that connects to the pickup 608 through a pivot point 610. The sensor module 108 may connect to the first amplification module 110 through a wired connection 612. While the apparatus 600 of FIG. 6 includes a sensor module 108 under the face 602 of the stringed instrument 102, the sensor module 108 may also be placed in a slot, as depicted in FIG. 5. Likewise, the sensor module 108 depicted in the apparatus 500 of FIG. 5 may be under the face 504 of the stringed instrument 102. Other means of directly coupling the string selector module 106 and sensor module 108 that substantially accomplish moving the sensor module 108 in direct response to movement of the string selector module 106 will be know to one skilled in the art.

FIGS. 7A-I are top, side, perspective, and/or exploded view drawings illustrating an apparatus for movable sensing for stringed instruments in accordance with one embodiment of the present invention. FIGS. 7A-I depict one embodiment of the system 100 of FIG. 1 where the stringed instrument 102 is an electric guitar. One of skill in the art will recognize that the stringed instrument 102 may be another type of instrument. The embodiment of FIGS. 7A-I include a tailpiece 1, one or more tailpiece stud bolt slots 2, one or more existing stud bolts 3 on the electric guitar, one or more tailpiece string holes 4, one or more tailpiece key holes 5, a tailpiece arm bolt hole 6, a tailpiece arm stop hole 7, an arm stop post 8, a tailpiece control panel bolt hole 9, an arm 10, an arm lock rod 11, one or more arm lock rod pins 12, one or more arm lock rod pin holes 13, an arm bolt 14, an arm bearing 15, one or more pickup plate mounting holes 16, an arm bolt hole 17, a control knob 20, one or more control knob holes 21, one or more control knob pins 22, one or more control knob pin holes 23, an electromagnetic pickup assembly 30, one or more pickup magnets 31, one or more center bobbins 32, one or more magnet holes 33, one or more mounting bolt holes 34, one or more eyelet holes 35, a top bobbin board 36, a bottom bobbin board 37, a pickup wire 38, one or more eyelets 39, an output cable, a pickup plate 41, an arm cable hole 42, a male phone jack (one-eighth inch male phone jack), one or more pickup plate mounting bolts 44, one or more pickup mounting spacers, an arm spacer 50, one or more arm spacer keys 51, an arm spacer bolt hole 52, one or more arm spacer lock notches 53, a counterweight 60, a threaded counterweight rod 61, a fine-tuner weight 62, a control panel plate 70, a control panel bolt 71, a control panel bolt hole 72, one or more control panel screws 73, one or more control panel screw holes 74, a control panel female phone jack (one-eighth inch female chassis mount phone jack) 75, a phase reverse and mute switch (DPDT on-off-on) 76, a volume potentiometer (25 k audio taper) 77, a volume control knob 78, a tone selector switch (SPDT on-off-on) 79, a tone capacitor (0.022 μf, 0.047 μf) 80,81, and a control panel output jack (one-quarter inch female chassis mount phone jack) 82.

In one embodiment, a string selector module 106 may include the tailpiece 1, tailpiece stud bolt slots 2, stud bolts 3, tailpiece string holes 4, tailpiece key holes 5, tailpiece arm bolt hole 6, tailpiece arm stop hole 7, arm stop post 8, tailpiece control panel bolt hole 9, arm 10, arm lock rod 11, arm lock rod pins 12, arm lock rod pin holes 13, arm bolt 14, arm bearing 15, pickup plate mounting holes 16, arm bolt hole 17, arm spacer 50, arm spacer keys 51, arm spacer bolt hole 52, arm spacer lock notches 53, counterweight 60, threaded counterweight rod 61, fine-tuner weight 62, control panel plate 70, control panel bolt 71, control panel bolt hole 72, control panel screws 73, and/or control panel screw holes 74.

In a further embodiment, a sensor module 108 may include the control knob 20, control knob holes 21, control knob pins 22, control knob pin holes 23, electromagnetic pickup assembly 30, pickup magnets 31, center bobbins 32, magnet holes 33, mounting bolt holes 34, eyelet holes 35, top bobbin board 36, bottom bobbin board 37, pickup wire 38, eyelets 39, an output cable, pickup plate 41, arm cable hole 42, a male phone jack (one-eighth inch male phone jack), pickup plate mounting bolts 44, pickup mounting spacers, control panel female phone jack (one-eighth inch female chassis mount phone jack) 75, phase reverse and mute switch (DPDT on-off-on) 76, volume potentiometer (25 k audio taper) 77, volume control knob 78, tone selector switch (SPDT on-off-on) 79, tone capacitor (0.022 μf, 0.047 μf) 80,81, and control panel output jack (one-quarter inch female chassis mount phone jack) 82. In another embodiment, hardware may be allocated differently between a string selector module 106 and a sensor module 108.

In one embodiment, the tailpiece 1, arm 10, pickup plate 41, and arm spacer 50 are milled from aluminum stock and/or plate, and/or milled, cast, and/or formed from other material or materials of sufficient structural strength. The tailpiece 1 may be attached to the electric guitar by one or more U-shaped tailpiece stud bolt slots 2 in the tailpiece 1 that mate with one or more existing tailpiece stud bolts 3 on the electric guitar. One or more tailpiece string holes 4 may be drilled through the tailpiece 1. In one embodiment, the string holes 4 are narrower than the ball end of the strings 104. The strings 104 are threaded through the string holes 4, and string tension holds the tailpiece in place against the stud bolts 3, anchoring the strings 104 to the tailpiece 1. One or more tailpiece key holes 5 may be drilled to accept the one or more arm spacer keys 51. The tailpiece arm bolt hole 6 may drilled and tapped, and the tailpiece arm stop hole 7 may be drilled. In some embodiments, the arm stop post 8 is glued in the tailpiece arm stop hole 7 to limit the travel of the arm 10. The tailpiece control panel bolt hole 9 may be drilled and tapped.

In one embodiment, the arm 10 is fitted with the arm lock rod 11. One or more arm lock rod pins 12 may be press fit into the two arm lock rod pin holes 13 to secure the arm lock rod 11. When engaged, the end of the arm lock rod 11 may fit into one of the arm spacer lock notches 53 in the arm spacer 50. The control knob 20, in one embodiment, is inserted into one of the control knob holes 21. The control knob 20 may be secured by the control knob pins 22 being inserted into control knob pin holes 23. One or more pickup plate mounting holes 16 may be drilled and tapped in the arm 10 for mounting the electromagnetic pickup assembly 30.

The electromagnetic pickup assembly 30 may consist of one or more pickup magnets 31 encased in one or more non-conductive center bobbins 32. In one embodiment, one or more magnet holes 33, one or more mounting bolt holes 34, and one or more eyelet holes 35 are drilled and/or punched into the top bobbin board 36. One or more magnet holes 33 may also be drilled and/or punched into the bottom bobbin board 37.The pickup magnets 31 in their respective center bobbins 32 may be press fit into magnet holes 33 in the top and bottom bobbin boards 36, 37. In one embodiment, the top and bottom bobbin boards 36, 37 are glued or otherwise fastened to the center bobbins 32. The pickup wire 38 may be wound around the center bobbins 32. In some embodiments, eyelets 39 are flared into the one or more eyelet holes 35. Each end of the pickup wire 38 may be soldered to each eyelet. A center conductor and shield of an insulated single conductor with the pickup output cable 40 may be soldered to the eyelets 39. The top bobbin board 36 of the assembled electromagnetic pickup assembly 30 may be glued to the pickup plate 41. In one embodiment, the free end of the output cable is routed through the arm cable hole 42 and soldered to male phone jack 43. The pickup plate 41 may be attached to the end of the arm 10 using one or more pickup plate mounting bolts 44 and one or more pickup mounting spacers 45, where the pickup plate mounting bolts 44 go into the pickup plate mounting holes 16 in the arm 10.

With the guitar resting on its back, the arm spacer 50 may be placed on the tailpiece 1 so that the one or more arm spacer keys 51 may be inserted into the corresponding tailpiece key holes 5. In one embodiment, the arm spacer 50 is centered on the tailpiece arm bolt hole 6. The arm 10 may be placed on top of the arm spacer 50 so that the arm bolt 14 may pass through the arm bolt hole 17 and the arm spacer 50 and go into the tailpiece arm bolt hole 6 to secure the arm 10. Friction in a joint of the arm 10 may be reduced by press fitting the arm bearing 15 so that the end of the arm 10 may move freely in an arc over the strings 104 of the stringed instrument 102.

In one embodiment, the counterweight 60 is attached to the end of the arm 10 opposite the electromagnetic pickup assembly 30. The counterweight 60 may be tapped, and, in one embodiment, is attached to the arm 10 by the threaded counterweight rod 61 which passes through the tapped counterweight 60 and into a counterweight rod hole bored and tapped in the arm 10. The tapped fine-tuner weight 62 may be screwed onto the threaded counterweight rod 61. In another embodiment, a counterweight 60 may be attached to the arm 10 without a fine-tuner weight 62. In a certain embodiment, the arm 10 may be used without a counterweight 60, or with a removable counterweight 60.

In one embodiment, the control panel plate 70 provides a mounting platform for electrical components of the electric guitar. The control panel plate 70 may be connected to the tailpiece 1 by the control panel bolt 71, which goes through the control panel bolt hole 72 and into the tailpiece control panel bolt hole 9 in the tailpiece 1. The other end of the control panel plate 70 may be attached to a heel of the guitar by one or more control panel screws 73 via one or more corresponding control panel screw holes 74. The male phone jack on the output cable from the pickup may plug in to the control panel female phone jack 75. The signal may be routed to a DPDT on-off-on switch configured as a phase reversing and mute switch 76. The signal may then be routed to the volume potentiometer 77 with volume control knob 78. The signal may then also be routed to a SPDT on-off-on switch configured as a tone selector 79 with associated tone capacitors 80, 81. The signal may then be routed to the control panel output jack 82.

In another embodiment, the tailpiece 1 is attached to the electric guitar by sliding it onto the guitars existing tailpiece studs 3. The guitar is then strung such that the strings 104 hold the tailpiece 1 in place. One end of the control panel plate 70 is bolted to the tailpiece 1 and the other end is attached to the heel of the guitar with one or more screws. The guitar may be laid on its back and the arm spacer 50 may be placed on the tailpiece 1 and mated with the arm spacer keys 51. The arm 10 may then be placed on the arm spacer 50. A bolt, in one embodiment, is inserted to keep the arm 10 and arm spacer 50 in place. The male phone jack on the pickup output cable 40 extending from the arm 10 may be plugged into the corresponding control panel female phone jack 75 on the control panel plate 70. One end of a guitar cable may be plugged into an output jack of the control panel plate 70, and the other end of the guitar cable may be plugged into the first or second amplification module 110, 116.

In one embodiment, the user ensures that the mute switch 76 is disengaged and that the volume control knob 78 is turned up sufficiently. The user may then place the palm of his or her hand on the control knob 20 and, while plucking or strumming the guitar, simultaneously move the arm 10 and electromagnetic pickup assembly 30 over the strings 104. The electromagnetic pickup assembly 30 may only sense the vibrating strings 104 that are within its sensing range, whereas other vibrating strings may not be sensed.

An overall output volume of the electric guitar may be increased or decreased by adjusting the volume control knob 78. A tone of the guitar may be left unaltered or the high frequencies may be rolled off based on the setting of the tone selector switch 79. In one embodiment, the phase of an output signal is inverted 180 degrees using the phase reversing and mute switch 76. The phase reversing and mute switch 76 may also have a mute setting for disconnecting the electromagnetic pickup assembly 30 from the overall output.

In some embodiments, varied and/or creative movement of the electromagnetic pickup assembly 30 over the vibrating strings 104 of the electric guitar produces a wide variety of audio effects. Additionally, the arm lock rod 11 may be used to fix the position of the electromagnetic pickup assembly 30 over the strings 104.

FIG. 8 depicts another embodiment of an apparatus 800 for movable sensing for stringed instruments. In one embodiment, the apparatus 800 includes a string selector module 106 and a sensor module 108, which may be substantially as described above with regard to FIG. 1. In the depicted embodiment, the string selector module 106 includes a mechanical arm 806, a tailpiece 816, a thumbscrew 802, an upper washer 804, a coil spring 830, a bearing 808, a bushing 810, a lower washer 812, an arm bushing bolt 814, tailpiece adjustment bolts 818, a flexible stop point 826 and a stop 828. In the depicted embodiment, the sensor module includes a pickup 820, a pickup plate 822, and a button post 824. In certain embodiments, the arm 806 and the pickup 820 may be similar to those described above in connection with FIGS. 7A-7I.

In one embodiment, the tailpiece 816, mechanical arm 806, and pickup plate 822 may be milled from aluminum stock and/or plate, and/or milled, cast, and/or formed from other material or materials of sufficient structural strength. The tailpiece 816 may be attached to a stringed instrument 102 to secure one end of the strings 104 in place. In general, in various embodiments, the arm 806 is coupled to the tailpiece 816 and pivots about a pivot point on the tailpiece 816, so that a user may select one or more strings 104 by moving a portion of the arm 806 over the one or more selected strings 104. In further embodiments, the pickup 820 is positioned on the arm 806 (via the pickup plate 822) so that the pickup 820 is over the one or more selected strings 104 when the user positions the portion of the arm 806 over the one or more selected strings 104. In some embodiments, various shapes for the tailpiece 816 may provide various positions for the arm 806 relative to the strings 104.

In one embodiment, a friction control device may adjust an amount of friction between the mechanical arm 806 and a pivot point. For example, in the depicted embodiment, an arm bushing bolt 814 secures a bushing 810 to the tailpiece. In another embodiment, a lower washer 812 is placed on the tailpiece 816 around the bushing 810. The arm 806 is coupled to the bushing 810 with a bearing 808 in between the arm 806 and the bushing 810, so that the arm 806 can pivot about the bushing 810. A thumbscrew 802 or similar device may be screwed into a threaded hole in the top of the bushing 810, to secure the arm 806 to the tailpiece 816. In one embodiment, a coil spring 830 and an upper washer 804 are disposed between the arm 806 and the thumbscrew 802. Thus, in certain embodiments, tightening the thumbscrew 802 compresses the assembly at the pivot point, increasing the friction between the arm 806 and the pivot point. In a further embodiment, loosening the thumbscrew 802 decreases the friction between the arm 806 and the pivot point, while the coil spring 830 avoids slack in the assembly that could result in undesirable upward or downward motion of the arm 806. Accordingly, in the depicted embodiment, the friction control device includes the thumbscrew 802, washers 804, 812, coil spring 830, bearing 808, and bushing 810. Other ways of adjusting the friction between the arm 806 and the pivot point will be clear to one of skill in the art.

In one embodiment, a height adjustment device that adjusts a distance between the sensor module 108 and the plurality of strings 104. For example, in the depicted embodiment, the pickup 820 for the sensor module 108 is coupled to the pickup plate 822. The pickup plate 822, in turn, is coupled to the arm 806, and the arm 806 is coupled to the tailpiece 816, as described above. Thus, the height of the pickup 822 above the strings 104 may be controlled by changing the height and/or angle of the tailpiece 816 relative to the plane of the strings, which in turn raises or lowers the arm 806, pickup plate 822, and pickup 820. In the depicted embodiment, a plurality of tailpiece adjustment bolts 818 extend toward the stringed instrument 102 from the tailpiece 816, tailpiece adjustment bolts 818 include felt pads that press against the face of the stringed instrument 102. Thus, adjusting one or more of the tailpiece adjustment bolts 818 can change the height or angle of the tailpiece 816, and thereby adjust the distance between the sensor module 108 (including the pickup 820) and the plurality of strings 104. In certain embodiments, standard tailpiece studs that attach the tailpiece 816 to the stringed instrument 102 may provide a crude height adjustment, and further adjustment of the tailpiece adjustment bolts 818 may set the angle of the tailpiece 816 and provide a finer height adjustment.

In one embodiment, a flexible stop point 826 coupled to the stringed instrument that limits travel of the mechanical arm 806. In a further embodiment, the mechanical arm 806 may move past the flexible stop point 826 in response to an action of the user. For example, in the depicted embodiment, the flexible stop point 826 is a flexible tab, that the arm 806 may rest on when the user releases the arm 806. A flexible stop point 826, in certain embodiments, may stop the arm 806 from dropping past the flexible stop point 826 when released by the user, and may keep the arm 806 within the user's easy reach. In a further embodiment, the flexible stop point 826 may be made of a flexible material, hinged, spring-loaded, or the like, so that it flexes out of the way in response to an action of the user, such as pushing the arm 806 past the flexible stop point 826 instead of merely releasing the arm 806. Thus, the flexible stop point 826 may hold the arm 806 in a convenient position for ready use, or may allow the arm 806 to be disposed in an out-of-the-way position if the user desires.

In one embodiment, a stop 828 may be coupled to the stringed instrument 102. In a further embodiment, the stop 828 may limit travel of the mechanical arm 806. For example, in the current embodiment, the stop 828 is coupled to the stringed instrument 102 via the tailpiece 816. In another embodiment, the stop 828 may be coupled directly to the stringed instrument. In various embodiments a stop 828 may be a metal post, wood peg, protrusion, a stop within a hinge-point, or the like, that limits travel of the arm 806. In other embodiments, the stop 828 is adjustable. For example, the stop 828 may move between various holes, may be adjusted within a slot, etc. In certain embodiments, excessive rotational travel of the arm 806 may damage output cables from the pickup 820. In further embodiments, the arm 806 or a counterweight may contact the stop 828 so that further motion is prevented. In the depicted embodiment, the apparatus 800 includes a flexible stop point 826 and a hard stop 828. In another embodiment, however, an apparatus 800 may include a single flexible stop point 826 or hard stop 828. In a certain embodiment, the pickup 820 may be coupled to an output via an electrical contact system for the arm 806 instead of via a flexible cable, and the stop 828 may be omitted if there is little risk of cables being damaged by excessive travel for the arm 806.

In the depicted embodiment, the sensor module 108 includes a pickup 820, a pickup plate 822, and a button post 824. In one embodiment, the pickup 820 may be similar to the pickup described above with regard to FIGS. 7A-7I. In another embodiment, the pickup 820 may have additional structure or features as described below. Various types of pickups will be clear to one of skill in the art. In the depicted embodiment, the pickup plate 822 couples the pickup 820 to the arm 806.

In various embodiments, a user of the stringed instrument 102 may shift the pitch of a string 104 significantly by "bending" the string 104, or pulling it significantly away from its usual position. Treble strings 104 are most likely to be bent. However, if bending a string 104 takes it significantly out of the range of the pickup 820, then in addition to a pitch effect, the volume may be significantly reduced. Thus, in a certain embodiment, the pickup 820 may be positioned with respect to the mechanical arm 806 such that, when the pickup 820 is positioned over treble strings 104 of the stringed instrument 102, a width of a pickup range across the strings 104 is greater than when the pickup 820 is positioned over bass strings 104 of the stringed instrument 102.

For example, in the depicted embodiment, the pickup 820 includes a width that extends generally across the longitudinal axis of the arm 806. By adjusting the angle of the pickup plate 822, the pickup 820 may be positioned so that its width extends directly (perpendicularly) across the treble strings 104 when the arm 806 is positioned over the treble strings 104. Thus, the pickup range may be widest over the treble strings 104, to facilitate "bending" of the treble strings 104 without loss of volume. As the arm rotates to a position over bass strings 104, the pickup 820 may rotate so that its width extends more obliquely across the bass strings 104. In certain embodiments, however, an oblique position for the pickup 820 above the bass strings 104 may provide a sufficiently wide pickup range if the bass strings 104 are not likely to be "bent."

In one embodiment, changing a width of the pickup 820 over the strings 104 is accomplished by having a pickup 820 that is oblong, rectangular, or otherwise longer in one dimension than another, and an arc of movement of the pickup 820 over the strings 104 changes an angle of the pickup 820 with respect to the strings 104 where the pickup 820 runs more in a direction of the strings 104 over the bass strings 104 and is rotated to cover more area as the pickup 820 moves over the treble strings 104. In another embodiment, the pickup 820 rotates with respect to the arm 806 so that the pickup 820 is in a position more in line with the strings 104 when over the bass strings 104 and then rotates to a position that covers the treble strings 104 when positioned over the treble strings 104. One of skill in the art will recognize other ways to widen coverage of the pickup 820 as the pickup 820 moves from bass strings 104 to treble strings 104.

In one embodiment, one or more holes in the pickup plate 822 and/or the arm 806 may be wider than the bolts or screws attaching the pickup plate 822 to the arm 806 through the holes, so that the angle of the pickup plate 822 relative to the arm 806 may be adjusted. In one embodiment, the button post 824 facilitates adjustment of the angle of the pickup plate 822, and may act as a small handle for moving the arm 806 when the apparatus 800 is in use. A larger handle or control knob may be attached to the arm 806, removably attached to the arm 806, or omitted, in various embodiments.

FIG. 9 is an electrical schematic diagram illustrating one embodiment of a sensor module 900. In a certain embodiment, the sensor module 900 may be substantially similar to the sensor module 108 described above with regard to FIG. 1. In the depicted embodiment, the sensor module 900 includes a magnetic pickup 902 and an electrically grounded wire coil 908 wrapped around the magnetic pickup 902.

In certain embodiments, a magnetic pickup 902 includes one or more magnets 904, and a wire coil 906 wrapped around the magnets 904 that produces a voltage in response to changes in the magnetic field. A vibrating metallic string 104 for the stringed instrument 102 changes the magnetic field, inducing a voltage in the coil 906. However, the pickup 902 may also sense induced electromagnetic radiation from transformers, lights, motors, and the like, which manifests as a hum in the output of the pickup 902. In certain embodiments, hum may be reduced by using a grounded metallic shield cover, or connecting a second pickup 902 in a "humbucking" configuration, with the poles of the magnets 904 and the winding direction of the coil 906 both reversed, so that the signal from the vibrating strings is approximately doubled, but the interference from ambient electromagnetic noise is cancelled. However, adding a metal cover or a pickup 902 in a humbucking configuration substantially increases the size of the sensor module 900. Thus, in the depicted embodiment, an electrically grounded wire coil 908 is wrapped around the magnetic pickup 902. In one embodiment, the grounded wire coil 908, like a grounded metal cover, shields the pickup 902 from ambient interference. The pickup coil 906 and the grounded coil 908 are depicted with few turns for convenience in illustration; in certain embodiments, the coils 906, 908 may both include many turns of fine magnet wire. In further embodiments, using a grounded coil 908 instead of a metal cover provides shielding for the pickup 902, with minimal changes to the size or appearance of the pickup 902.

Figure 10:
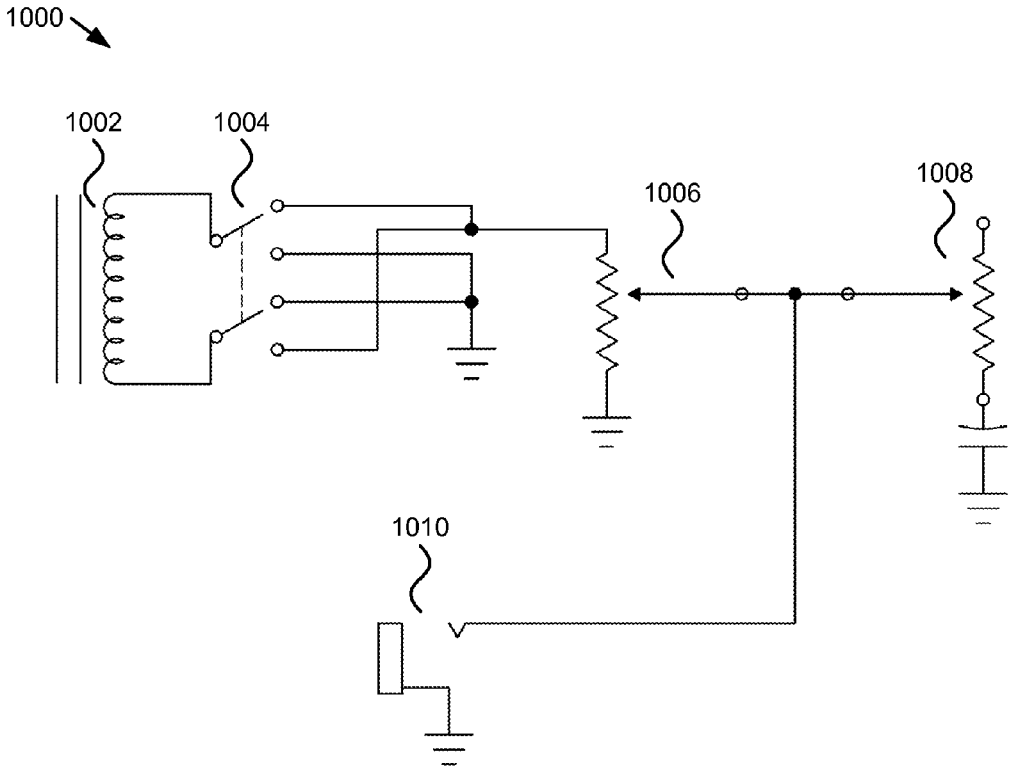
FIG. 10 is an electrical schematic diagram illustrating another embodiment of a sensor module.

FIG. 10 is an electrical schematic diagram illustrating another embodiment of a sensor module 1000 and associated electrical components. In a certain embodiment, the sensor module 1000 may be substantially similar to the sensor module 108 described above with regard to FIG. 1. In the depicted embodiment, the sensor module includes a pickup 1002, a double-pole, double-throw ("DPDT") switch 1004, a volume control variable resistor 1006, a tone control variable resister 1008, and an output jack 1010.

In the depicted embodiment, the pickup 1002 produces an electrical signal in response to vibration of the one or more selected strings 104, as described above. In a further embodiment, the DPDT switch 1004 allows a user to reverse the phase of the signal from the pickup 1002. While a DPDT switch 1004 is depicted, one of skill in the art will recognize other ways to reverse the phase of the signal from the pickup 1002. In certain embodiments, the volume control resistor 1006 allows a user to reduce the amplitude of the signal, and the tone control resistor 1008 allows a user to control the attenuation of high frequencies. Other mechanisms may also be used to vary resistance or signal strength. In another embodiment, the tone control resistor 1008 may be replaced by a switch that connects or disconnects a capacitor between the output and ground, so that high frequencies are attenuated when the capacitor is connected. In a certain embodiment, the output jack 1010 may be a mono jack, since the pickup 1002 produces a single signal. For example, in one embodiment, the sensor module 1000 signal output may be provided separately from the stringed instrument 102 signal output, and the stringed instrument 102 may have its own output jack (or may be an acoustic instrument), so that the output jack 1010 for the sensor module 1000 is only used for the signal from the sensor module 1000. In another embodiment, however, a sensor module 1000 may be built into a stringed instrument 102, and the output jack 1010 may be a stereo jack that carries the signal from the sensor module 1000 on one stereo channel and the signal from one or more main sensors 114 for the stringed instrument 102 on another stereo channel.

Figure 11:
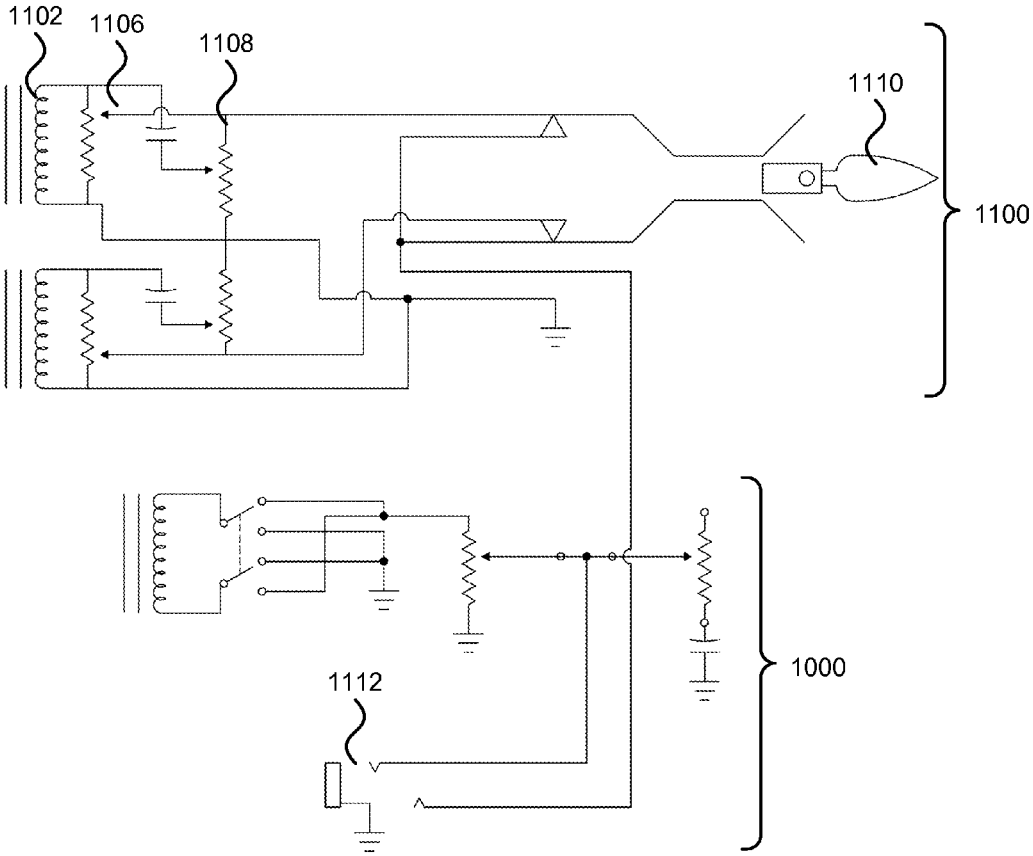
FIG. 11 is an electrical schematic diagram illustrating one embodiment of a sensor module integrated with main sensors for a stringed instrument.

FIG. 11 is an electrical schematic diagram illustrating one embodiment of a sensor module 1000 integrated with main sensors 1100 for a stringed instrument 102. For example, in the depicted embodiment, the sensor module 1000 may be manufactured with the stringed instrument 102, and integrated with the main sensors 1100. The sensor module 1000 may be substantially as described above with regard to FIG. 10, and the main sensors 1100 may be substantially as described above with regard to the main sensors 114 of FIG. 1. In the depicted embodiment, the main sensors 1100 include one or more pickups 1102. In a further embodiment, each pickup 1102 may have a corresponding volume control resistor 1106 and tone control resistor 1108 or other mechanism to vary signal strength. In the depicted embodiment, the main sensors 1100 include two pickups 1102, and a pickup selector switch 1110 allows a user to switch the output between either or both pickups 1102.

In the depicted embodiment, the stringed instrument 102 includes a stereo output jack 1112. In a certain embodiment, a first electrical signal from the main sensors 1100 (in response to vibration of the plurality of strings 104) is coupled to a first stereo output channel for the stereo output jack 1112. In a further embodiment, a second electrical signal from the sensor module 1000 (in response to vibration of one or more selected strings) is coupled to a second stereo output channel for the stereo output jack. In certain embodiments, a first amplification module may amplify the first electrical signal, a second amplification module may amplify the second electrical signal, and a splitter module may connect the first electrical signal from the stereo output jack 1112 to the first amplification module and connect the second electrical signal from the stereo output jack 1112 to the second amplification module.

Figure 12:
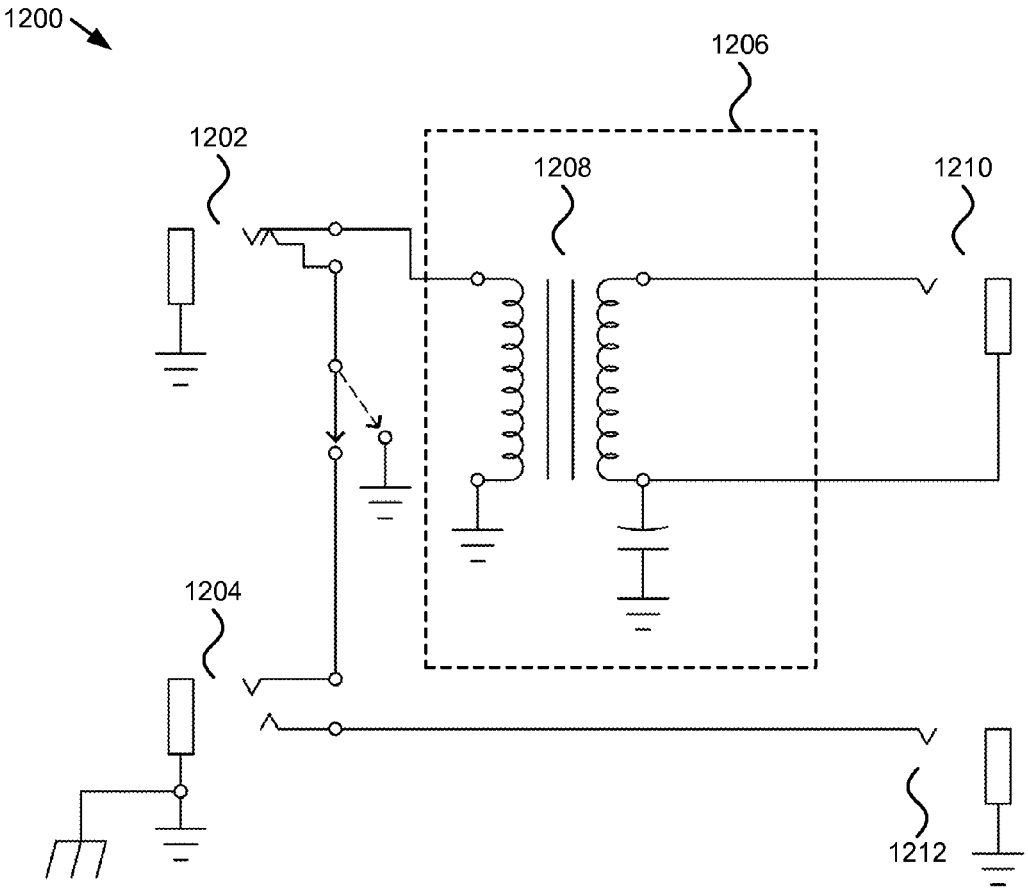
FIG. 12 is an electrical schematic diagram illustrating one embodiment of a splitter module.

FIG. 12 is an electrical schematic diagram illustrating one embodiment of a splitter module 1200. In the depicted embodiment, the splitter module 1200 includes a mono input 1202, a stereo input 1204, a first mono output 1210, a second mono output 1212, and an isolation transformer module 1206. A signal received at the stereo input 1204 may include a first signal from a sensor module 108 on one stereo channel, and a second signal from one or more main sensors 114 on another stereo channel. In the depicted embodiment, the splitter module outputs the first signal on the first mono output 1210, and outputs the second signal on the second mono output 1212, so that the mono outputs 1210, 1212 can be connected to separate amplification modules 110, 116. Alternatively, a first signal from the sensor module 108 may be connected to the mono input 1202, and output at the first mono output 1210, without splitting a stereo signal, so that the isolation transformer module 1206 may still be used with the first signal.

Due to practical considerations, the first signal and the second signal may have a common electrical ground in the stringed instrument 102. If the electrical ground for both signals is connected to the electrical ground for two separate amplification modules, a ground loop hum can result. Thus, in certain embodiments, an isolation transformer module 1206 may isolate an electrical ground for (or connected to) a first amplification module from an electrical ground for (or connected to) a second amplification module. In the depicted embodiment, the isolation transformer module 1206 includes an isolation transformer 1208. In a certain embodiment, the primary and secondary windings for the isolation transformer 1208 may have an equal number of turns. In a further embodiment, the primary winding may be connected to an input (e.g., mono input 1202 or one channel of stereo input 1204), and to ground, and the secondary winding may be connected to an output 1210, but lifted from ground via a capacitor. Thus, the isolation transformer module 1206 may isolate the ground connector for the first mono output 1210 from the ground connector for the second mono output 1212. In the depicted embodiment, the splitter module 1200 includes the isolation transformer module 1206. In another embodiment, however, the isolation transformer module 1206 may be provided separately from the splitter module 1200.

The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a string selector module that selects one or more strings of a stringed instrument in response to a user of the stringed instrument positioning at least a portion of the string selector module over the one or more selected strings, the stringed instrument comprising a plurality of strings, the plurality of strings comprising the one or more selected strings and one or more unselected strings; and a sensor module that produces an electrical signal in response to vibration of the one or more selected strings, wherein the string selector module moves the sensor module over the strings of the stringed instrument at a prescribed distance from the strings.

2. The apparatus of claim 1, wherein the electrical signal produced by the sensor module comprises a first electrical signal and wherein the stringed instrument further comprises one or more main sensors that generate a second electrical signal in response to vibration of the plurality of strings for the stringed instrument, wherein the first electrical signal differs from the second electrical signal.

3. The apparatus of claim 1, wherein the sensor module is coupled to the string selector module and the sensor module moves with the string selector module when the user positions the string selector module to select the one or more selected strings.

4. The apparatus of claim 3, wherein the sensor module comprises a pickup and the string selector module comprises a mechanical device where a portion of the mechanical device passes over the strings of the stringed instrument, the pickup being positioned on the mechanical device to pass over the strings of the stringed instrument as the portion of the mechanical device passes over the strings.

5. The apparatus of claim 4, wherein the mechanical device comprises a mechanical arm that pivots about a pivot point, wherein a portion of the mechanical arm passes over the strings of the stringed instrument, and wherein the pickup is positioned on the mechanical arm to pass over the strings of the stringed instrument as the portion of the mechanical arm passes over the strings.

6. The apparatus of claim 5, further comprising a friction control device that adjusts an amount of friction between the mechanical arm and the pivot point.

7. The apparatus of claim 5, further comprising a stop coupled to the stringed instrument that limits travel of the mechanical arm.

8. The apparatus of claim 5, further comprising a flexible stop point coupled to the stringed instrument that limits travel of the mechanical arm, wherein the mechanical arm moves past the flexible stop point in response to an action of the user.

9. The apparatus of claim 5, wherein the pickup is positioned with respect to the mechanical arm such that, when the pickup is positioned over treble strings of the stringed instrument, a width of a pickup range across the strings is greater than when the pickup is positioned over bass strings of the stringed instrument.

10. The apparatus of claim 4, wherein the mechanical device comprises a slider in a channel positioned over the strings of the stringed instrument, wherein the slider passes over the strings of the stringed instrument, and wherein the pickup is positioned on the slider such that the pickup passes over the strings of the stringed instrument as the slider passes over the strings.

11. The apparatus of claim 1, further comprising a height adjustment device that adjusts a distance between the sensor module and the plurality of strings.

12. The apparatus of claim 1, wherein the sensor module comprises a magnetic pickup and an electrically grounded wire coil wrapped around the magnetic pickup.

13. An apparatus comprising:

a string selector module that selects one or more strings of a stringed instrument in response to a user of the stringed instrument positioning at least a portion of the string selector module over the one or more selected strings, the stringed instrument comprising a plurality of strings, the plurality of strings comprising the one or more selected strings and one or more unselected strings; and a sensor module that produces an electrical signal in response to vibration of the one or more selected strings, wherein the string selector module is positioned external to the stringed instrument and is configured to pass over the strings of the stringed instrument, wherein the sensor module comprises a pickup for each string, and wherein the string selector module comprises a position for each string of the stringed instrument, wherein the sensor module activates a pickup to detect sound for a string in response to the string selector module being positioned to correspond to the string.

14. The apparatus of claim 13, wherein the string selector module comprises a mechanical device and a position sensor, wherein the position sensor determines a position of the mechanical device with respect to the one or more strings, wherein the string selector module selects the string corresponding to the position of the mechanical device as determined by the position sensor, and wherein the string selector module activates the pickup corresponding to the selected string.

15. The apparatus of claim 14, wherein the position sensor determines a position of the mechanical device relative to the plurality of strings, and wherein the string selector module activates the pickups corresponding to the selected strings.

16. An apparatus comprising:

a string selector module that selects one or more strings of a stringed instrument in response to a user of the stringed instrument positioning at least a portion of the string selector module over the one or more selected strings, the stringed instrument comprising a plurality of strings, the plurality of strings comprising the one or more selected strings and one or more unselected strings; and a sensor module that produces an electrical signal in response to vibration of the one or more selected strings, wherein the string selector module is positioned external to the stringed instrument and is configured to pass over the strings of the stringed instrument and wherein the sensor module is positioned within the stringed instrument at a location between the strings of the stringed instrument and a center of the stringed instrument, wherein movement of the string selector module to pass over the strings causes movement of the sensor module under the strings, and wherein a position of the string selector module relative to the one or more strings positions the sensor module under the one or more strings.

17. The apparatus of claim 16, wherein the sensor module is positioned in a slot in a face of the stringed instrument such that the sensor module is exposed to the strings of the stringed instrument.

18. The apparatus of claim 16, wherein movement of the selector module causes movement of the sensor module by a coupling mechanism.

19. The apparatus of claim 18, wherein the coupling mechanism comprises one or more of:

a direct coupling mechanism that directly connects the string selector module to the sensor module; and an indirect coupling mechanism indirectly connects the string selector module to the sensor module, wherein the indirect coupling mechanism moves the sensor module in response to detecting movement of the string selector module.

20. The apparatus of claim 1, wherein the stringed instrument is manufactured with one or more of the selector module and the sensor module.

21. The apparatus of claim 1, wherein the selector module and the sensor module are provided separately from the stringed instrument.

22. The apparatus of claim 1, further comprising an isolation transformer module that isolates an electrical ground for a first amplification module, that amplifies the electrical signal from the sensor module, from an electrical ground for a second amplification module, that amplifies a second electrical signal from one or more main sensors that produce the second electrical signal in response to vibration of the plurality of strings for the stringed instrument.

23. A system comprising:

a stringed instrument comprising a plurality of strings and one or more main sensors that produce a first electrical signal in response to vibration of the plurality of strings;

a string selector module that selects one or more strings of the stringed instrument in response to a user of the stringed instrument positioning at least a portion of the string selector module over the one or more selected strings, wherein the plurality of strings comprises the one or more selected strings and one or more unselected strings; and a sensor module that produces a second electrical signal in response to vibration of the one or more selected strings, wherein the string selector module moves the sensor module over the strings of the stringed instrument at a prescribed distance from the strings.

24. The system of claim 23, wherein the stringed instrument further comprises a stereo output jack, wherein the first electrical signal is coupled to a first stereo output channel for the stereo output jack and the second electrical signal is coupled to a second stereo output channel for the stereo output jack.

25. The system of claim 23, further comprising a splitter module, a first amplification module that amplifies the first electrical signal, and a second amplification module that amplifies the second electrical signal, wherein the splitter module connects the first electrical signal from the stereo output jack to the first amplification module and connects the second electrical signal from the stereo output jack to the second amplification module.

26. An apparatus comprising:

a string selector module that selects one or more strings of a stringed instrument in response to a user of the stringed instrument positioning at least a portion of the string selector module over the one or more selected strings, the stringed instrument comprising a plurality of strings, the plurality of strings comprising the one or more selected strings and one or more unselected strings, wherein the string selector module comprises a mechanical arm that pivots about a pivot point, wherein a portion of the mechanical arm passes over the strings of the stringed instrument when the user positions the string selector module to select the one or more selected strings;

a sensor module comprising a pickup that produces an electrical signal in response to vibration of the one or more selected strings, wherein the pickup is positioned on the mechanical arm to pass over the strings of the stringed instrument as the portion of the mechanical arm passes over the strings;

a first amplification module that amplifies the electrical signal from the sensor module;

a second amplification module that amplifies a second electrical signal from one or more main sensors that produce the second electrical signal in response to vibration of the plurality of strings for the stringed instrument; and an isolation transformer module that isolates an electrical ground for the first amplification module from an electrical ground for the second amplification module.

* * * * *